US009314935B2

(12) United States Patent
Everett

(10) Patent No.: US 9,314,935 B2
(45) Date of Patent: Apr. 19, 2016

(54) FLOOR GROOVER

(71) Applicant: Ken Everett, Richmond, IL (US)

(72) Inventor: Ken Everett, Richmond, IL (US)

( * ) Notice: Subject to any disclaimer, the term of this patent is extended or adjusted under 35 U.S.C. 154(b) by 175 days.

(21) Appl. No.: 13/726,083

(22) Filed: Dec. 22, 2012

(65) Prior Publication Data

US 2013/0160303 A1 Jun. 27, 2013

Related U.S. Application Data

(60) Provisional application No. 61/579,358, filed on Dec. 22, 2011.

(51) Int. Cl.

| | |
|---|---|
| ***B26B 29/06*** | (2006.01) |
| ***B26B 27/00*** | (2006.01) |
| ***B26B 25/00*** | (2006.01) |
| ***B26D 3/06*** | (2006.01) |
| *E04F 21/20* | (2006.01) |

(52) U.S. Cl.

CPC ..... *B26B 29/06* (2013.01); *B26B 25/00* (2013.01); *B26B 27/00* (2013.01); *B26D 3/06* (2013.01); *E04F 21/20* (2013.01)

(58) Field of Classification Search

CPC ..... B26B 3/08; B26B 29/06; B26B 29/02; B26B 5/00; B26B 25/00; B26B 25/002; B26B 25/005; B26B 25/007; B26B 27/00

USPC ..... 30/286, 287, 289, 293, 294, 299, 314, 30/316, 317, 320

See application file for complete search history.

(56) References Cited

U.S. PATENT DOCUMENTS

| | | | | |
|---|---|---|---|---|
| 4,064,626 | A * | 12/1977 | Meshulam et al. | 30/287 |
| 4,605,253 | A * | 8/1986 | Anderson | A47G 27/0487 156/71 |
| 5,203,086 | A * | 4/1993 | Dann | 30/293 |
| 5,438,757 | A * | 8/1995 | Weschenfelder | B26B 5/005 30/139 |
| 5,656,126 | A | 8/1997 | Martinez | |
| 5,715,605 | A * | 2/1998 | Nadeau | 30/293 |
| 6,112,417 | A * | 9/2000 | Hyer et al. | 30/290 |
| 6,557,262 | B1 * | 5/2003 | Clemence et al. | 30/156 |
| 6,640,446 | B2 * | 11/2003 | Martinez | 30/294 |
| 6,647,628 | B1 * | 11/2003 | Braaksma | 30/294 |
| 6,862,812 | B2 * | 3/2005 | Muhlebach | 30/293 |
| 6,871,013 | B2 | 3/2005 | Martinez | |
| 6,938,292 | B1 * | 9/2005 | Iannacone, Jr. | A47G 27/0487 30/294 |
| 7,062,858 | B2 * | 6/2006 | Hirsch | B23B 51/101 30/169 |
| 7,571,753 | B2 | 8/2009 | Martinez | |
| D613,573 | S * | 4/2010 | Latta et al. | D8/98 |

(Continued)

FOREIGN PATENT DOCUMENTS

| | | |
|---|---|---|
| CN | 101205759 | 3/2011 |
| EP | 0 787 572 | 10/2001 |

(Continued)

*Primary Examiner* — Jason Daniel Prone
*Assistant Examiner* — Richard Crosby, Jr.
(74) *Attorney, Agent, or Firm* — Hinshaw & Culbertson LLP

(57) ABSTRACT

A floor groover used to facilitate specialized heat welding of floor covering materials. The groover cuts a groove for receiving a welding rod at the edges or seam of abutting pieces of flooring materials. The groover can provide for a groove not only up to the wall, but also up the wall and in the radius of the coved-sticked area. Some embodiments of the groover can provide enhanced freedom of movement, which can be helpful when creating grooves of certain shapes in the flooring.

17 Claims, 28 Drawing Sheets

(56) References Cited

U.S. PATENT DOCUMENTS

| | | | | |
|---|---|---|---|---|
| 7,695,210 | B1 | 4/2010 | Martinez | |
| D639,835 | S | 6/2011 | Martinez | |
| 8,567,075 | B2 * | 10/2013 | Hetts et al. | 30/287 |
| 2007/0028455 | A1 * | 2/2007 | Ranieri et al. | 30/162 |
| 2008/0078089 | A1 | 4/2008 | Martinez | |

FOREIGN PATENT DOCUMENTS

| | | |
|---|---|---|
| EP | 1 321 251 | 1/2006 |
| EP | 1 422 045 | 6/2006 |
| EP | 1 935 617 | 12/2012 |
| TW | I309989 | 5/2009 |

* cited by examiner

FLOOR GROOVER

CROSS-REFERENCE TO RELATED APPLICATION

This patent application claims the benefit of U.S. Provisional Patent Application No. 61/579,358, filed Dec. 22, 2011, which is incorporated by reference in its entirety herein.

BACKGROUND

When installing certain floor coverings in specialized environments, such as surgical rooms, laboratories, or other environments where floor covering requires an impermeable barrier, the abutting of the floor covering material, also known as a "seam," requires a heat welding process, such as by using hot air, to fuse the adjacent flooring materials together. Flash coving can be integral with the flooring and can travel up the wall, vertically, in some applications by approximately four to six inches. The coving can also include a radius to ease and support the flooring material as it continues up the wall, to act as a containment and non-permeable barrier. Typically, a groove is made at the seam for receiving a welding rod that is heated to melt the rod and secure the connection between adjacent floor coverings.

BRIEF SUMMARY

The floor groover is used to facilitate specialized heat welding of floor covering materials. The groover cuts a groove for receiving a welding rod at the edges or scam of abutting pieces of flooring materials. The groover can provide for a groove not only up to the wall, but also up the wall and in the radius of the cove stick area. The cover stick can be reinforcing material that is disposed between the floor and the wall to provide a concave or rounded transition at the 90° intersection between the floor and the wall to ensure that the floor covering material is guided smoothly up the wall without crimping, buckling, or cracking. This provides reinforcement from impact from furniture, cans. or other objects. Some embodiments of the groover can provide enhanced freedom of movement, which can be helpful when creating grooves of certain shapes in the flooring.

The groover provides a manually operated device which is ergonomically designed for hand-use with a wide and comfortable grip. It can house one or more guide-wheels, such as at near the front and middle of the groover, suitable for following tight seams. The groover can also include one or more grooving blades, such as near the front and rear. The groover can provide a continuous and uniform groove.

The rear blade can pivot into one or more grooving positions. For example, in some embodiments, the rear blade can be moved to one position for horizontal floors up to an abutment and other positions for a vertical wall and a radius coved-area.

The middle grooving blade is inclined rearwardly, with its grooving tip located behind the two guide-wheels. The positioning of this blade can permit a controlled ejection of the chip, such as in a low plane near in the middle of the tool and between the two wheels so as not to ensnare, tangle, or cause interference as the seam is grooved. With both of the guide wheels mounted in front of the grooving blade, the expelled chip is directed downwardly and underneath the tool, and between the rear wheels for later disposal.

The rear grooving blade can cut both upwardly (vertical) and downwardly so as to complete the cut in the wall and the cove stick area. The groover can be reversed, and then inverted, to cut down, and in the same reversed position, but not inverted, the device can be moved in an upward direction to complete the groove up the wall.

DETAILED DESCRIPTION

Figure 1:
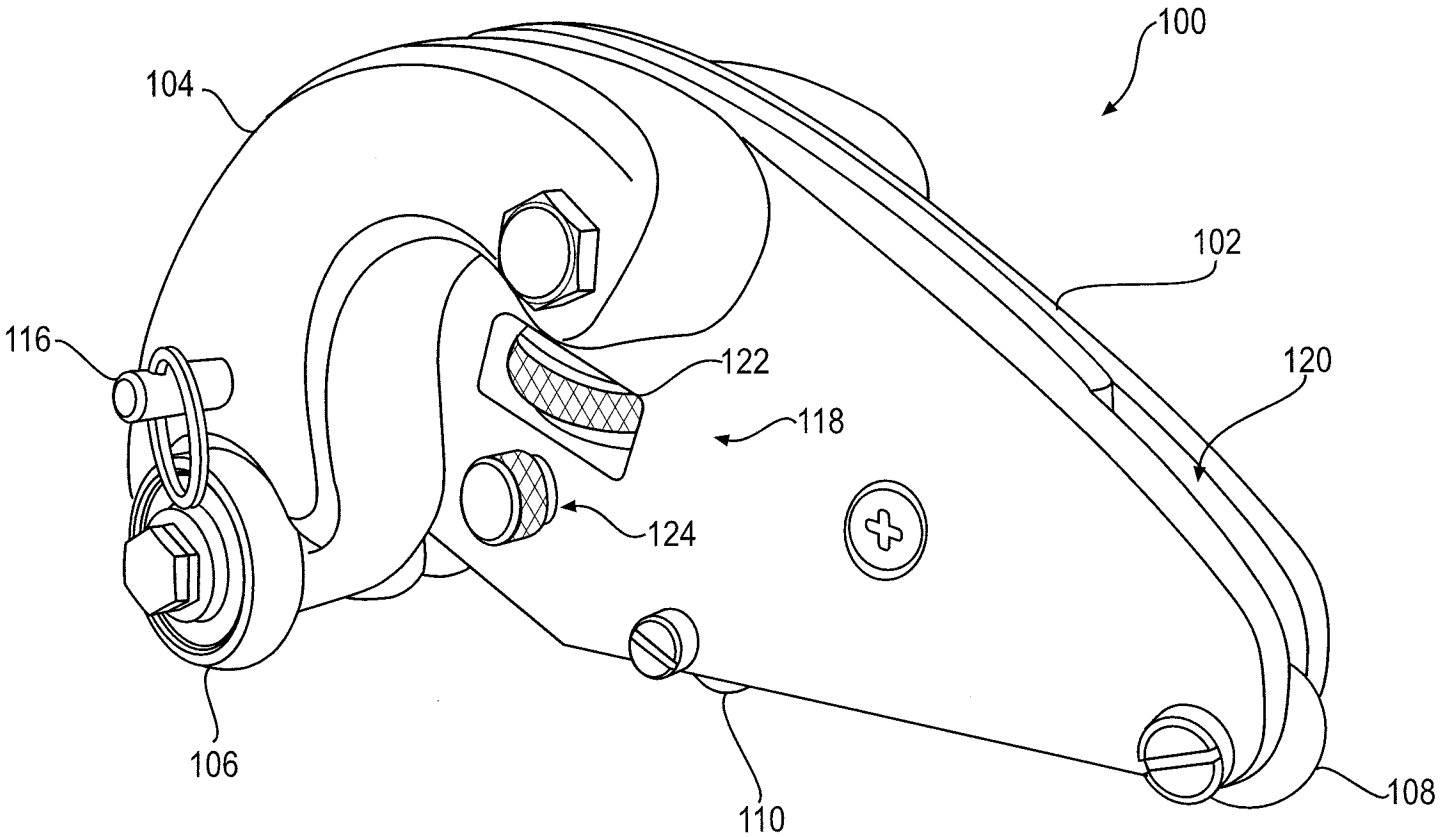
FIG. 1 is a perspective view of a an embodiment of a floor groover.

Referring to FIGS. 1-12, a floor groover 100 is shown. The floor groover 100 can include a body 102, a handle 104, one or more main wheels 106, one or more guide wheels 108, 110, one or more grooving blades 112, 114, a locking pin 116, and one or more blade adjustment mechanisms 118. The body 102 can be made of any suitable material and can be rigid to support the various components of the floor groover 100. The body 102 can include a sight guide 120 near the front of the groover 100 to permit a user to observe the path of the groover 100 with respect to a seam. The handle 104 can be attached to the body 102 and can include one or more pieces, such as two pieces disposed on opposing sides near the rear of the body 102. The handle 104 can have a suitable shape for providing an ergonomic grip for a user's hand. For example, the handle 104 can include a suitable contour for contact with a user's palm, and an undercut for a user's fingers. The handle 104 can also be made of any suitable material.

The main wheels 106 can be disposed near the rear of the device and can be of a suitable size to provide a controlled movement across a surface. The main wheels 106 can include bearings to further smooth their rotation.

The groover 100 can include one or more guides suitable for insertion into, and movement along, a seam. As shown, the guide wheels 108, 110 can be relatively thin discs having V-shaped cross-sections extending downwardly below a bottom side of tool body 102 to pointed edges that can be inserted into the seam and can rotate as the groover 100 is moved along the seam. In other embodiments, the guide can have an alternative suitable shape, such as generally square or rectangular when viewed perpendicular to the seam, that can fit within a seam. As shown, two guide wheels 108, 110 can be used to enhance the steadiness of the movement of the groover 100 and permit the groover 100 to accurately follow the seam. The guide wheels 108, 110 can be disposed at any suitable position on the body 102, such as near the front of the groover 100 and near a midpoint of the groover 100 and/or near a grooving blade 112.

Figure 2:
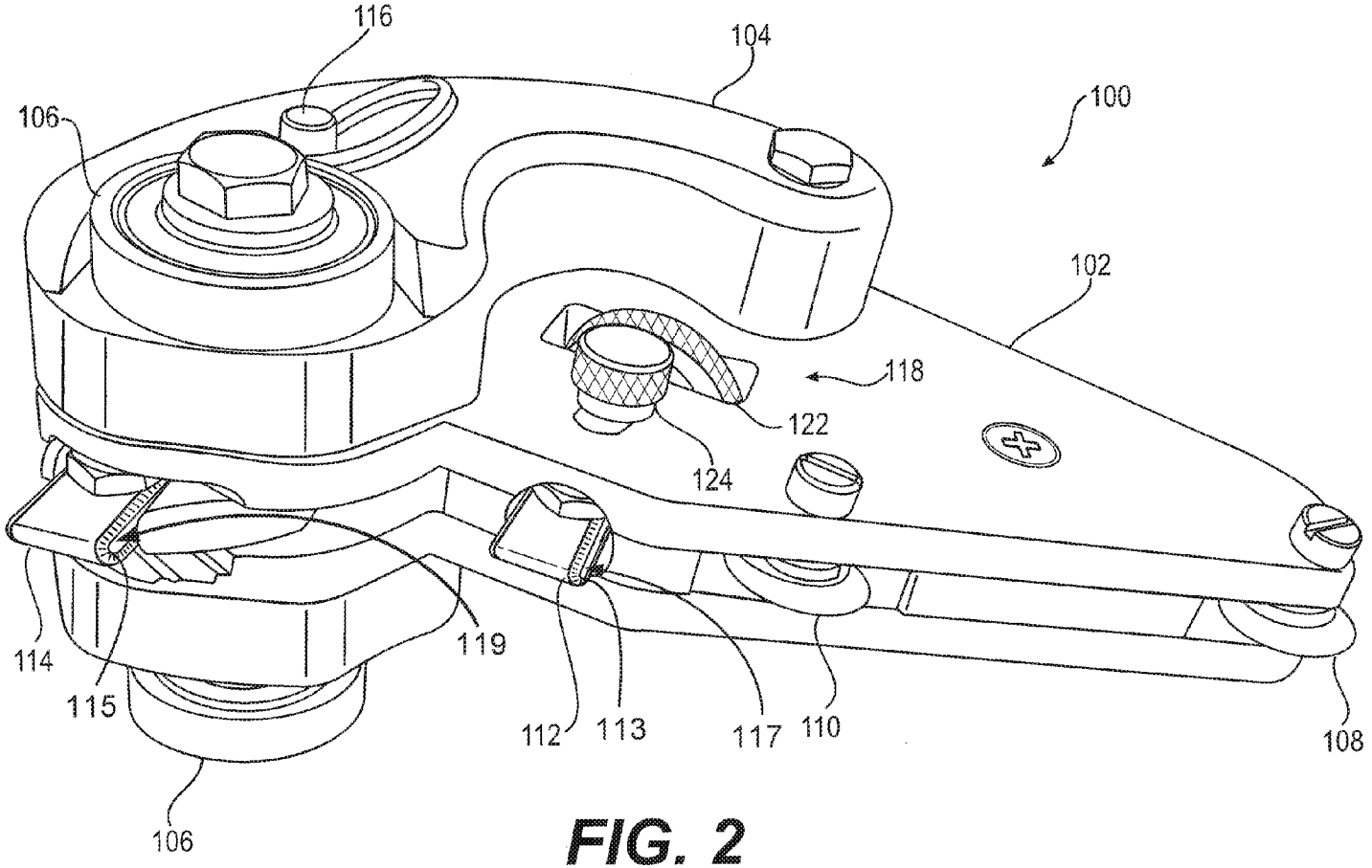
FIG. 2 is a bottom side perspective view of the floor groover of FIG. 1.
Figure 3:
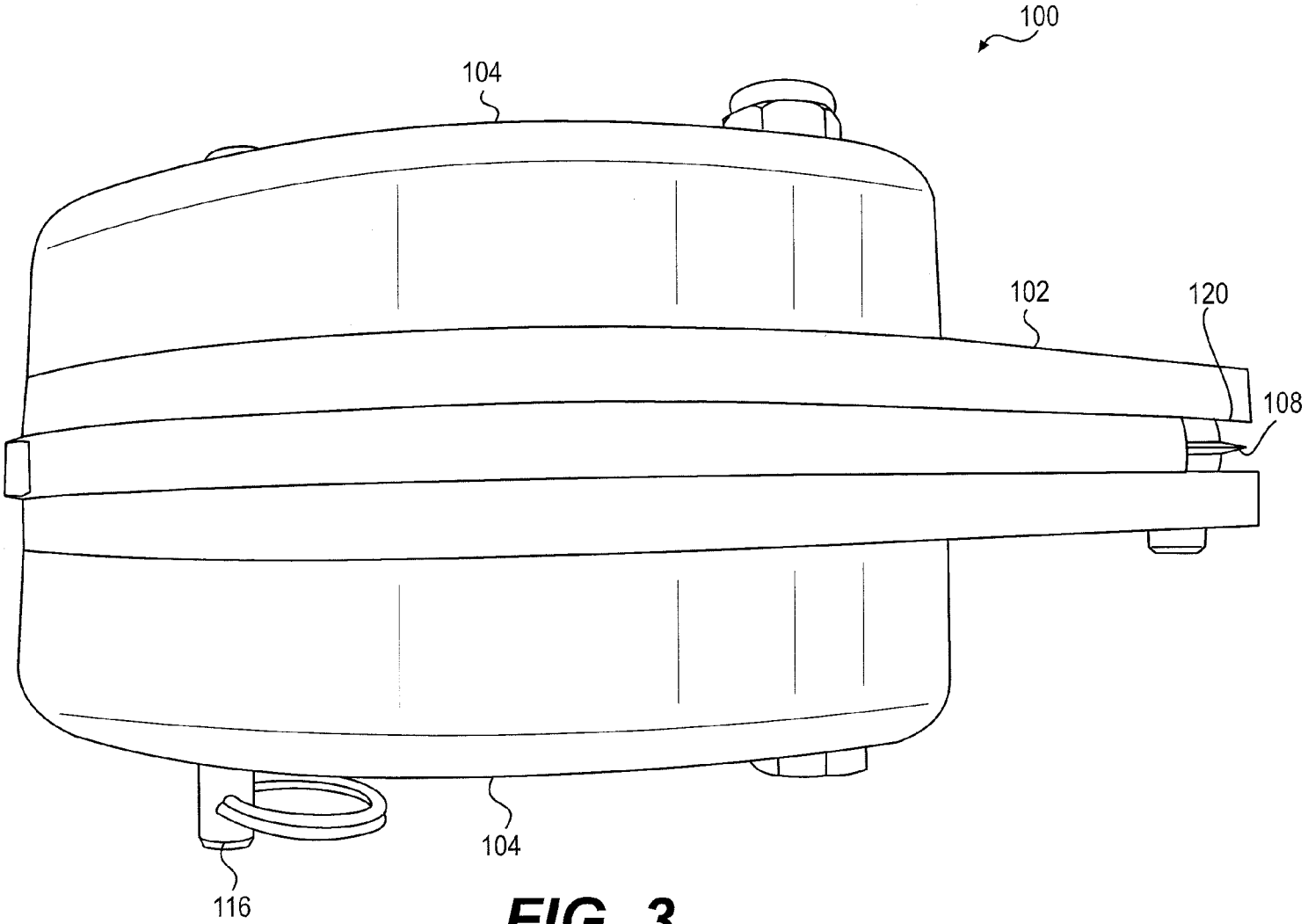
FIG. 3 is a top plan view of the floor groover of FIG. 1.
Figure 4:
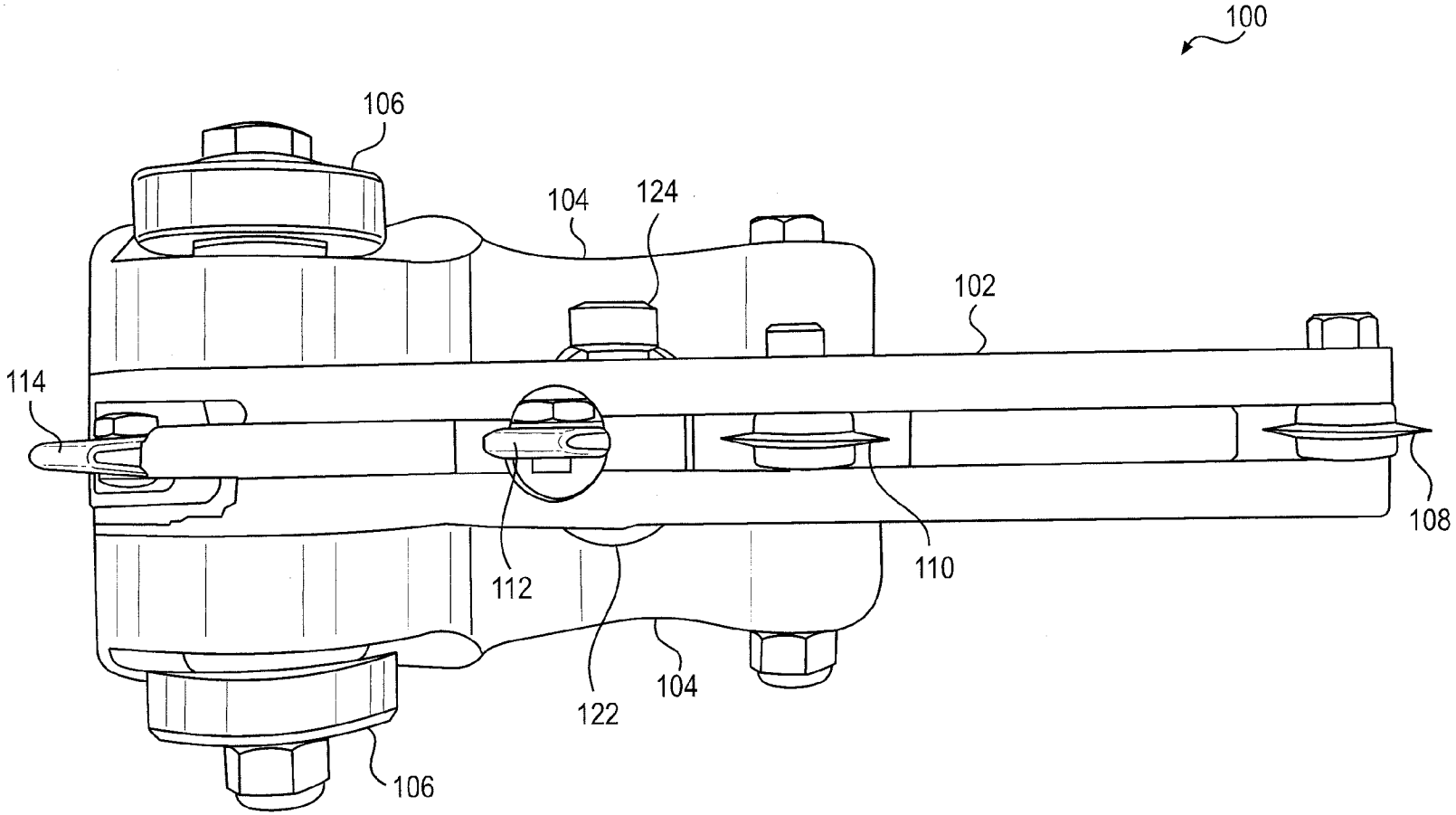
FIG. 4 is a bottom view of the floor groover of FIG. 1.
Figure 5:
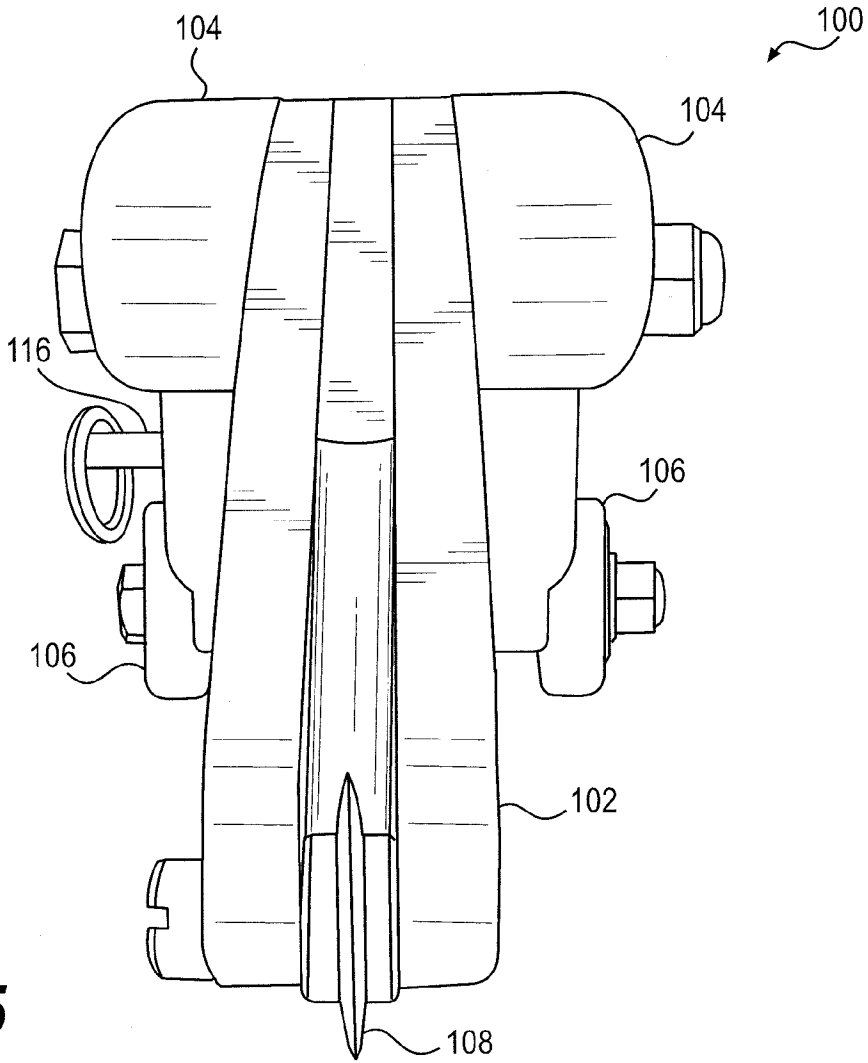
FIG. 5 is a front side view of the floor groover of FIG. 1.
Figure 6:
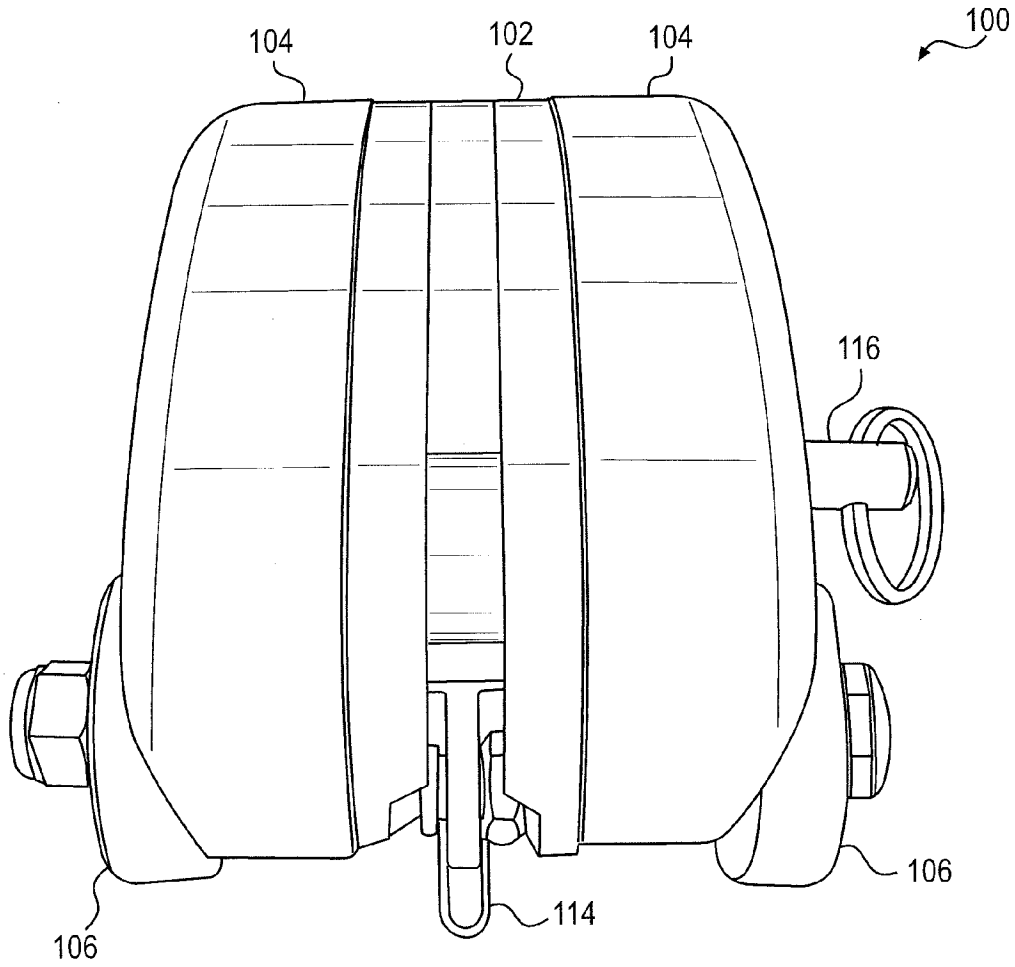
FIG. 6 is a rear side view of the floor groover of FIG. 1.
Figure 7:
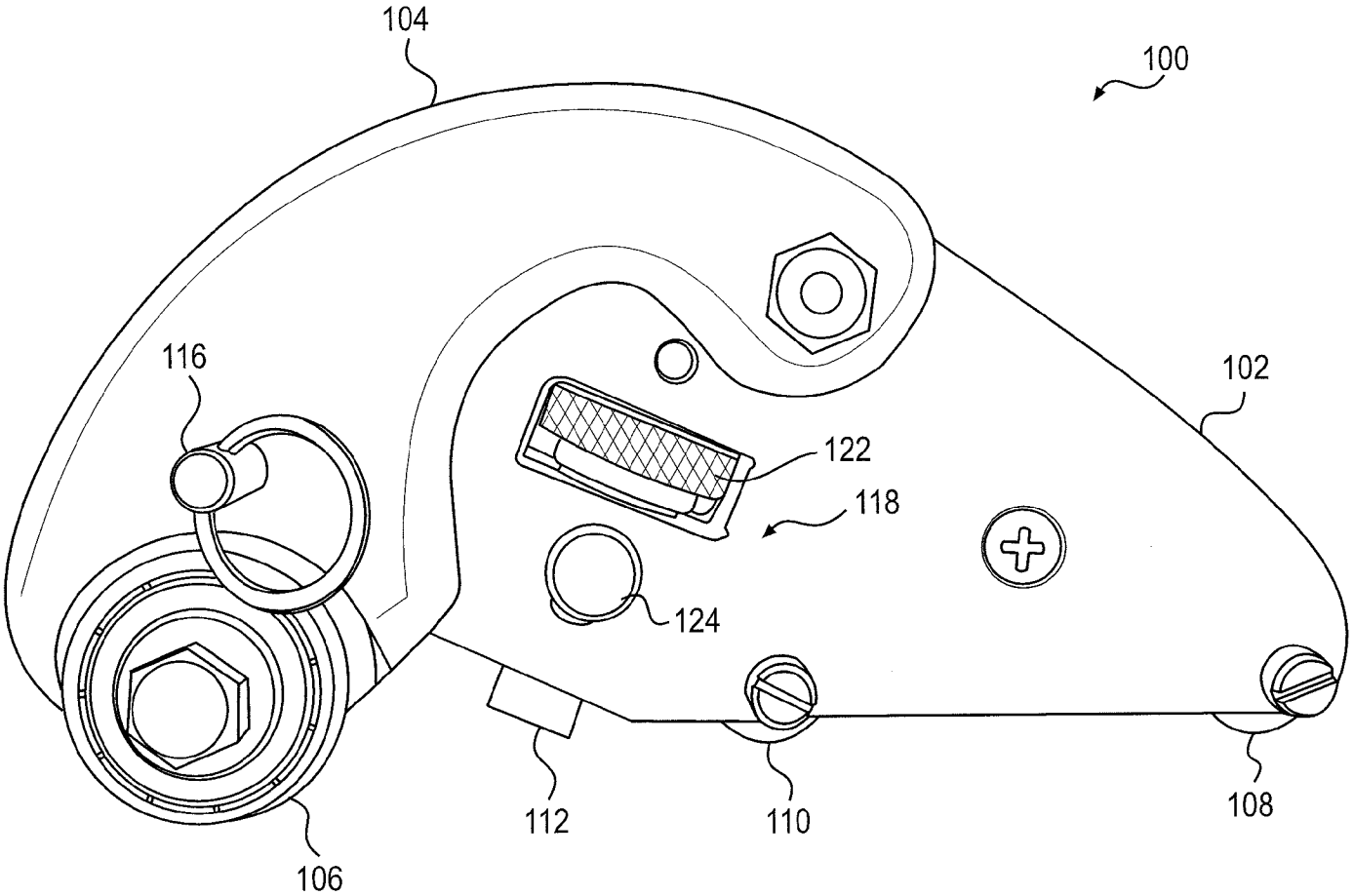
FIG. 7 is a side view of the floor groover of FIG. 1.
Figure 8:
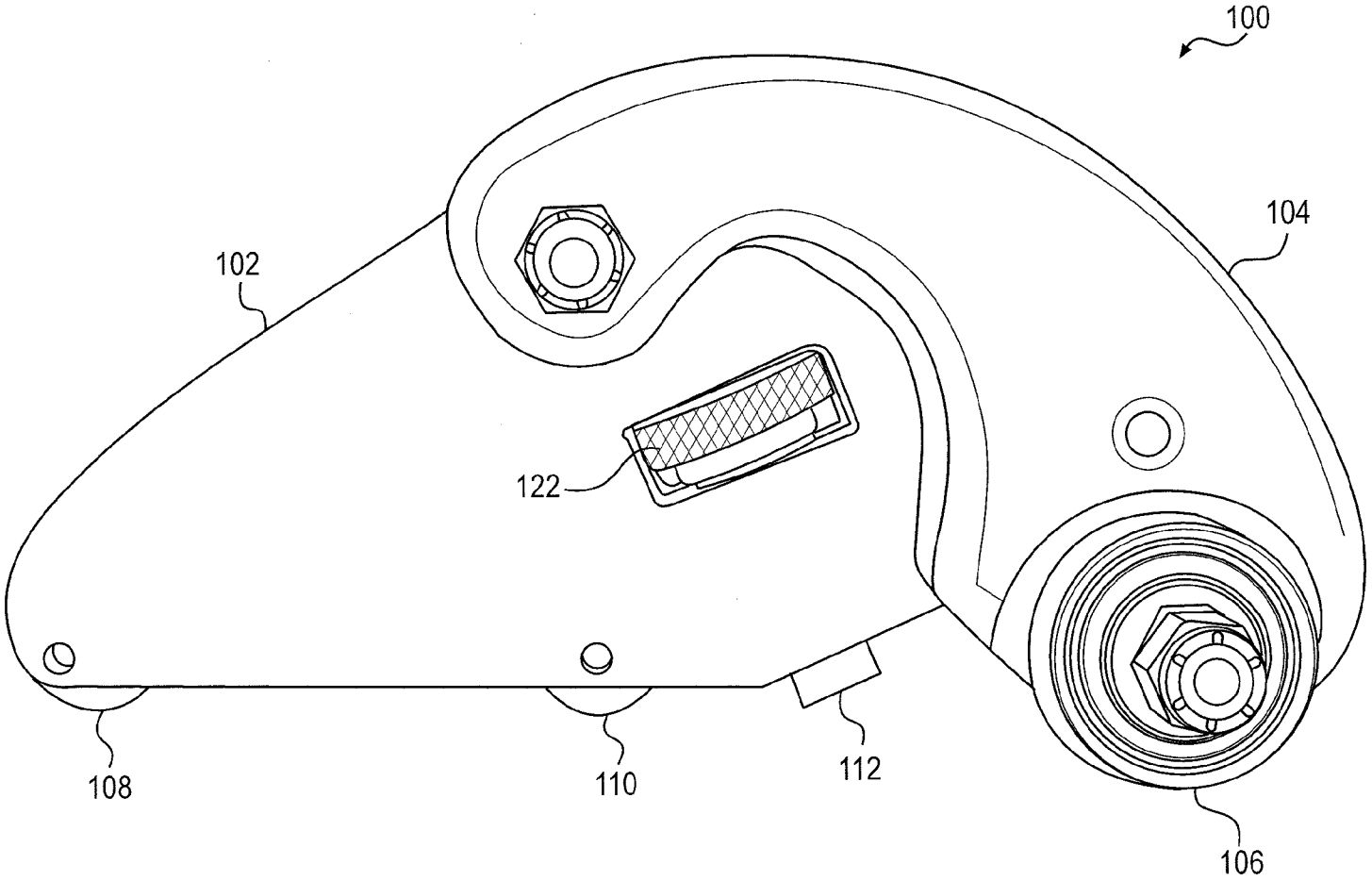
FIG. 8 is another side view of the floor groover of FIG. 1.

The groover can have any suitable number of grooving blades disposed in any suitable positions on the groover 100. For example, the groover 100 can have a main grooving blade 112, which is a generally U-shaped grooving blade having a cutting edge 113 and a groove cutting channel 117 as indicated in FIG. 2, disposed generally centrally on the body 102. The main grooving blade 112 can be disposed at a suitable angle to provide a controlled and reliable grooving of the flooring material. The main blade 112 can be removably attached to the body 102 such that it can be replaced when it becomes worn. An adjustment mechanism 118 can include a thumbscrew 122 for raising and lowering the main grooving blade 112 to a desired position. This permits the user to adjust the depth of the groove. A locking screw 124 can be used to lock the position of the main grooving blade 112 and to release the blade 112 for raising and lowering with the thumbscrew 122, and removal.

The groover 100 can also include a secondary grooving blade 114, which is a generally U-shaped grooving blade having a cutting edge 115 and a groove cutting channel 119 as indicated in FIG. 2. The secondary grooving blade 114 can be used to groove the flash coving and the wall. The secondary grooving blade 114 can be pivotable between any suitable number of positions. For example, when the secondary grooving blade 114 is not being used, it can be pivoted to a retracted position within the body 102 and/or handle 104. When the wall us being grooved, the secondary grooving blade 114 can be pivoted to an extended position (or "wall grooving orientation") for grooving the wall, in which cutting edge 115 is disposed rearwardly of tool body 102. Similarly, when grooving the flash coving, the secondary grooving blade 114 can be moved to another extended position such that the blade 114 can reach into and groove the radius of the flash coving.

Figure 9:
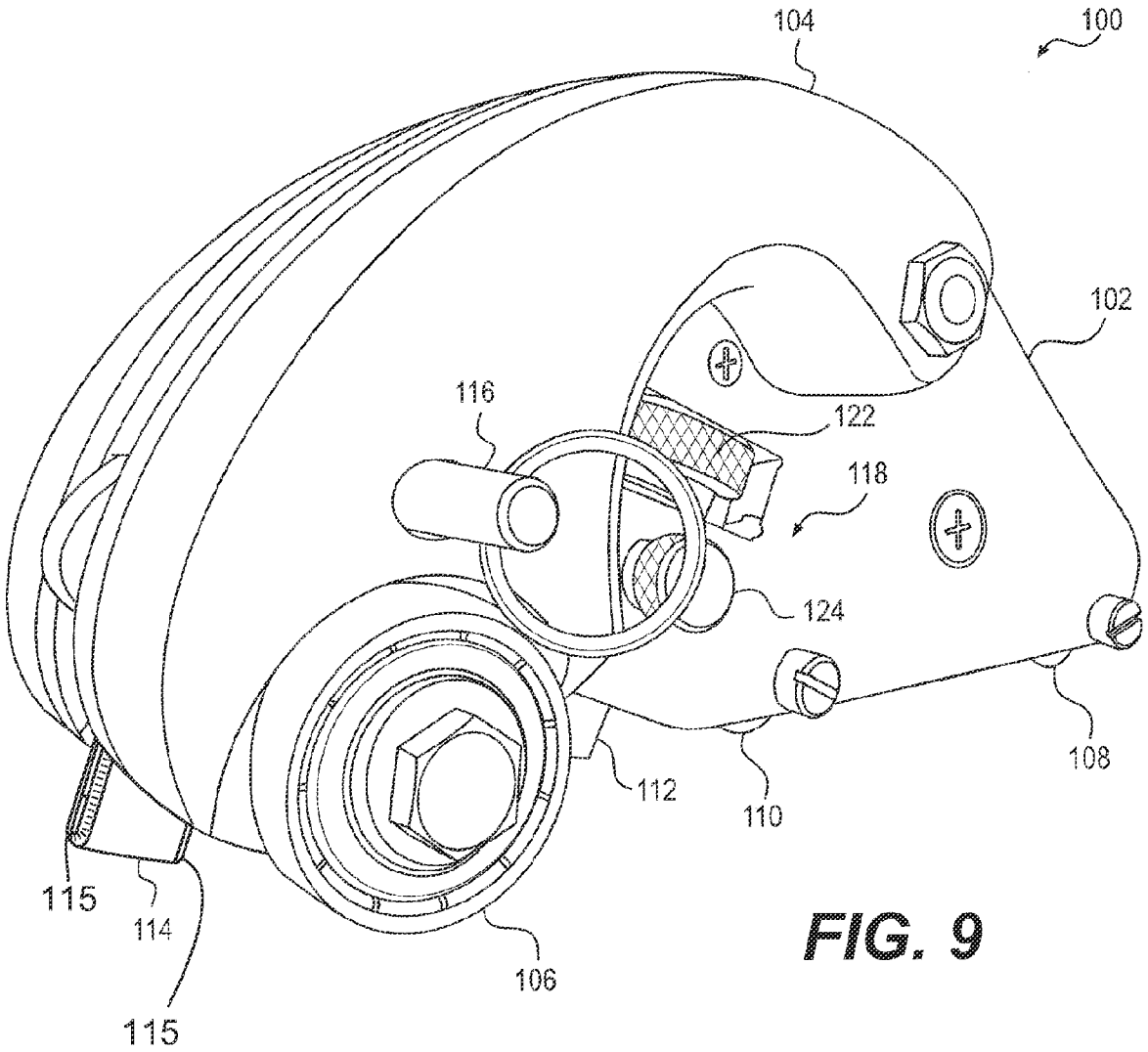
FIG. 9 is a rear perspective view of the floor groover of FIG. 1.
Figure 10:
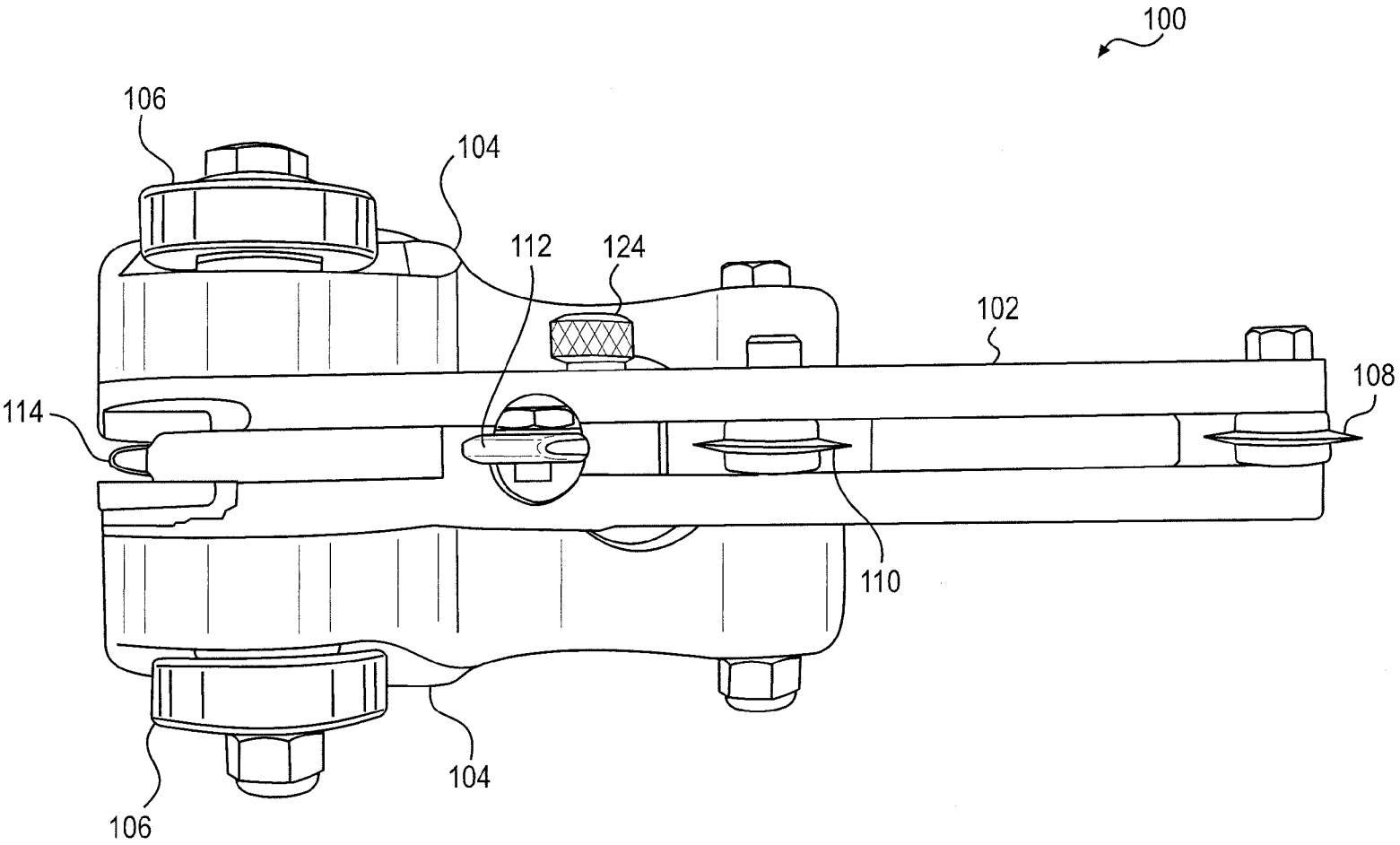
FIG. 10 is a bottom view of the floor groover of FIG. 1 with the secondary grooving blade in a retracted position.
Figure 11:
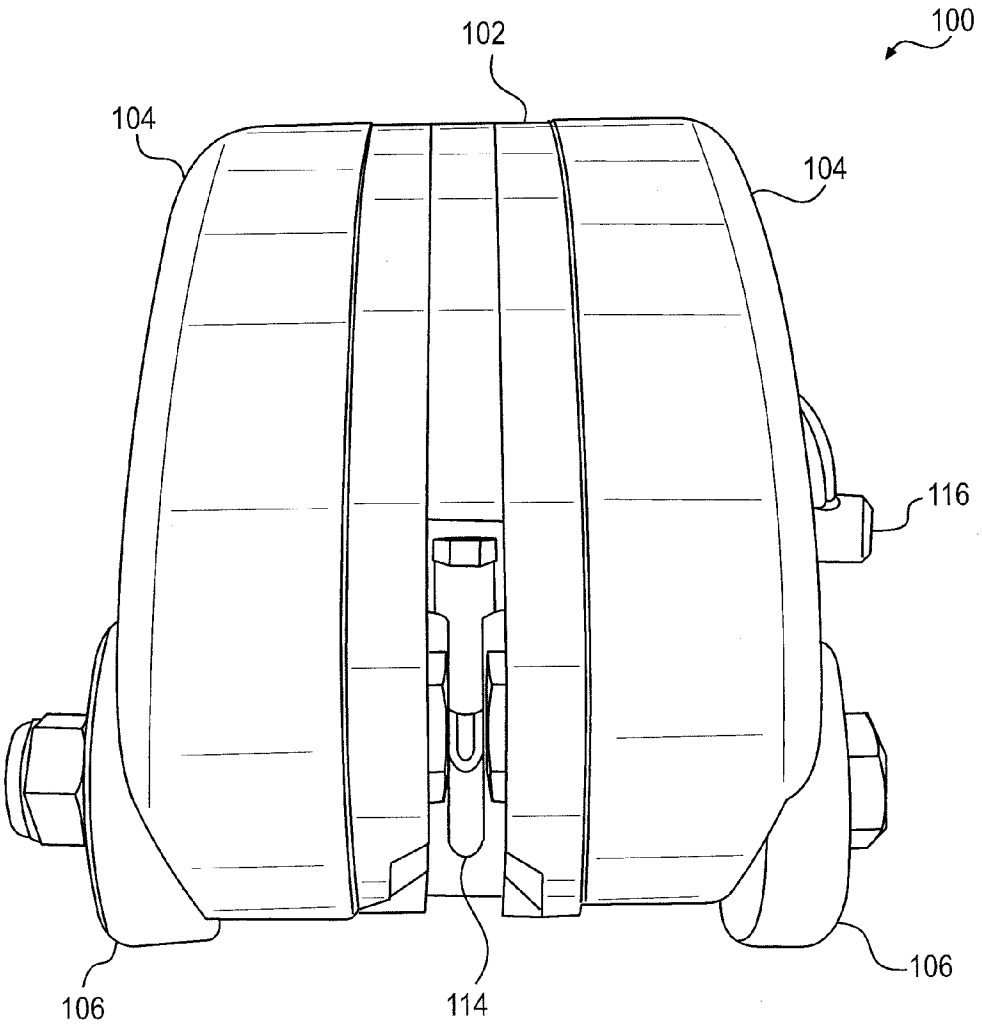
FIG. 11 is a rear side view of the floor groover of FIG. 1 with the secondary grooving blade in a retracted position.
Figure 12:
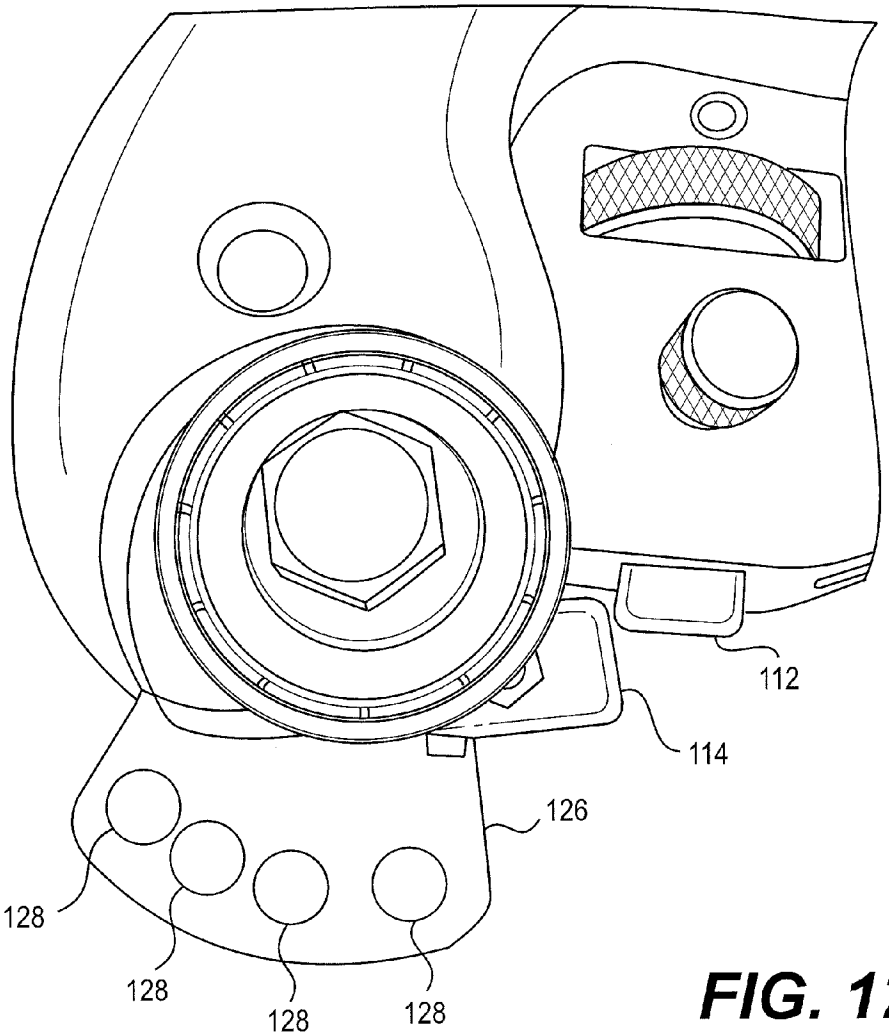
FIG. 12 is a fragmentary side view of the floor groover of FIG. 1 with the secondary grooving blade rotated to show the apertures permitting various positioning of the secondary grooving blade.
Figure 13:
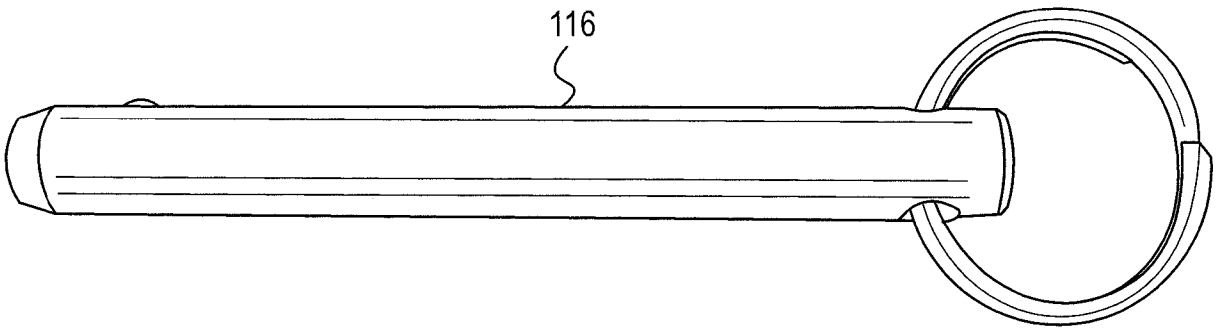
FIG. 13 is a side view of a locking pin for the secondary grooving blade of the floor groover of FIG. 1.

A locking pin 116 can be provided to permit both the adjustability and position locking of the secondary grooving blade 114. The locking pin 116 (see FIG. 13) can slide out of and into engagement with a the handle 104, body 102, and rear blade adjustment block 126, which is attached to the secondary grooving blade 114, to respectively release and retain the secondary grooving blade 114 in a desired position with respect to the body 102. FIG. 12 shows the rear blade adjustment block 126 pivoted out of the body 102 and handle 104 such that adjustment openings 128 can be seen in the block 126. The locking pin 116 can slide into the adjustment opening 128 corresponding to the desired position of the secondary grooving blade 114. For example, FIGS. 10 and 11 show the secondary grooving blade 114 in a retracted position, and FIG. 9 shows the secondary grooving blade 114 pivoted to an extended position. The adjustment block 126 can have any suitable number of adjustment openings 128 disposed at any suitable position to position the secondary grooving blade 114. In applications where it is not needed for the groover 100 to groove the wall and flash coving, the secondary grooving blade 114 can be excluded from the device.

Figure 15:
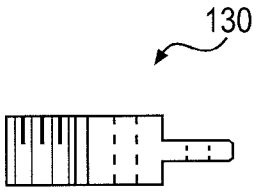
FIG. 15 is another plan view of a grooving blade holder for the floor groover of FIG; 1
Figure 14:
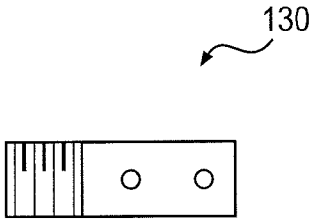
FIG. 14 is a plan view of a grooving blade holder for the floor groover of FIG. 1.

FIGS. 14 and 15 show a suitable grooving blade holder 130 for use with the floor groover. When assembled, the grooving blade holder 130 can be disposed within the body. The grooving blade holder 130 can be coupled to the grooving blade 112 and can be part of the blade adjustment mechanism 118. The grooving blade holder 130 can be attached to the thumbscrew 122 to raise and lower the grooving blade. The grooving blade holder 130 can be locked in place via tightening of the locking screw 124, which can contact the grooving blade holder 130.

Referring now to FIGS. 16-23, another embodiment of a floor groover 200 is shown. This embodiment of the floor groover 200 has a configuration suitable for grooving complicated patterns (for artistic or other purposes) in the flooring. The arrangement of the components can be such that the floor groover 200 has a relatively small radius of curvature allowing it to make sharp turns. For example, the floor groover can have a length approximately equal to or less than five inches. As a further example, the floor groover can have a length of approximately 4 inches. In another example, the floor groover can have a length of approximately 4 and 3/32 inches. It will be appreciated that the floor groover 200 may be any suitable shape and size.

The floor groover 200 can include a body 202, a handle 204, one or more main wheels 206, a guide wheel 208, grooving blade 212, and one or more blade adjustment mechanisms 218. The body 202 can be made of any suitable material and can be rigid to support the various components of the floor groover 200. The body 202 can include a sight guide 220 near the front of the groover 200 to permit a user to observe the path of the guide wheel 208 with respect to the seam. The handle 204 can be attached to the body 202 and can include one or more pieces, such as two pieces disposed on opposing sides near the rear of the body 202. The handle 204 can have a suitable shape for providing an ergonomic grip for a user's hand. For example, the handle 204 can include a suitable contour for contact with a user's palm, and an undercut for a user's fingers. The handle 204 can also be made of any suitable material.

The main wheels 206 can be disposed near the rear of the device 200 and can be of a suitable size to provide a controlled movement across a surface. The main wheels 206 can include bearings to further smooth their movement.

The groover 200 can include one or more guides suitable for insertion into, and movement along, a seam. As shown, the guide wheel 208 can be a relatively thin disc such that it can be inserted into the seam. In other embodiments, the guide can have an alternative suitable shape, such as generally square or rectangular when viewed perpendicular to the seam, that can fit within a seam. The guide wheel 208 can be used to enhance the steadiness of the movement of the groover 200 and permit the groover 200 to accurately follow the seam. The guide wheel 208 can be disposed at any suitable position on the body 202, such as near the front of the groover 200 and near the grooving blade 212.

Figure 15A:
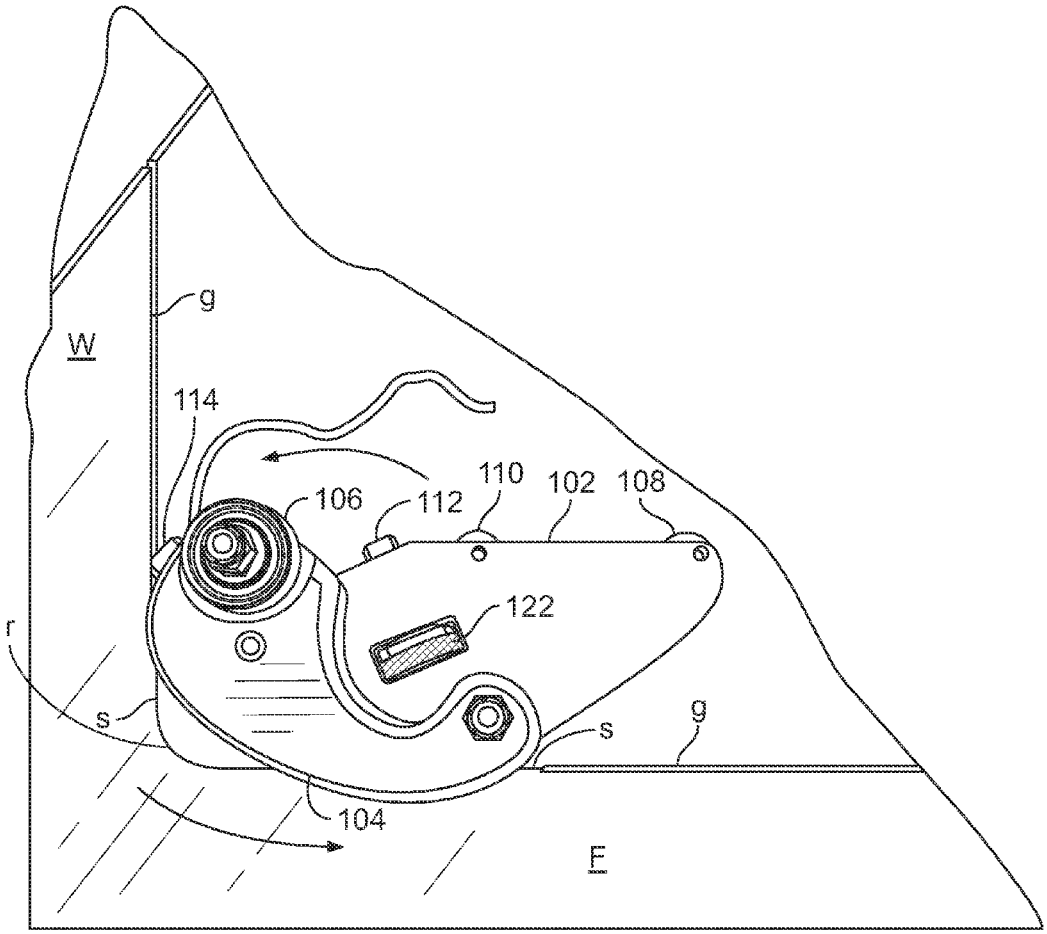
FIG. 15A is a side view of the floor groover of FIG. 1 in a reversed and inverted position disposed to complete a cut down a wall and around a radiused cove stick area between the wall and an adjacent floor.
Figure 15B:
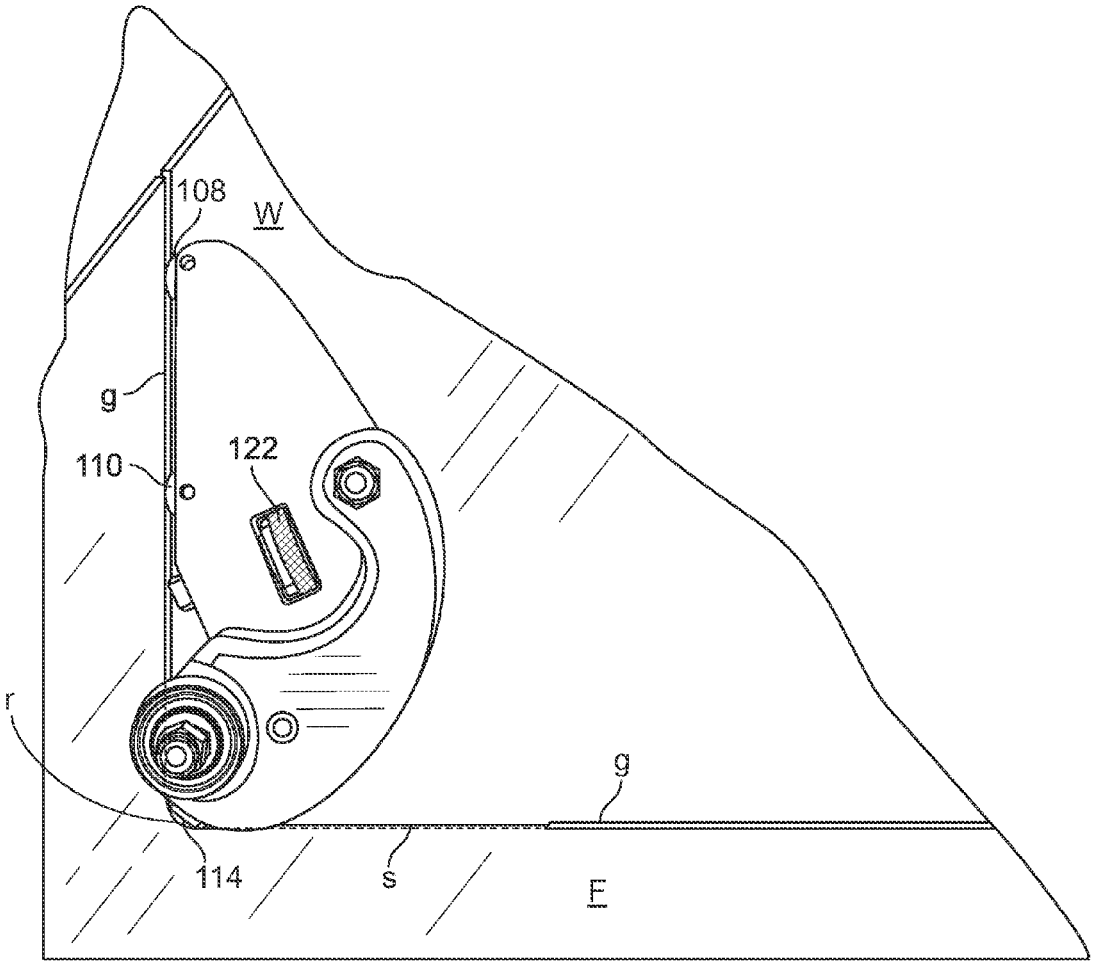
FIG. 15B is a side view of the floor groover of FIG. 1 at the completion of a cutting stroke initiated from the position shown in FIG. 15A.
Figure 15D:
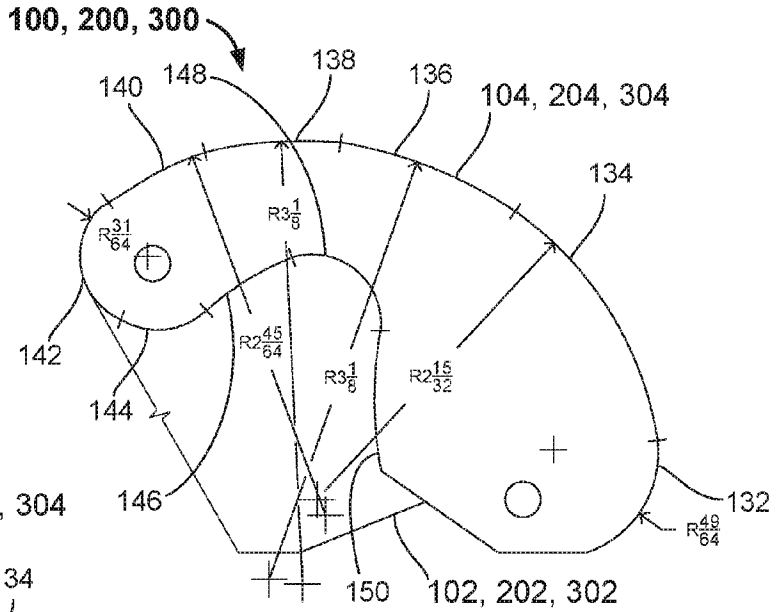
FIG. 15D is a fragmentary side elevation view of a floor groover as shown in FIG. 15C, including labeling of the curvature of the handle at regions unlabeled in FIG. 15C.
Figure 15C:
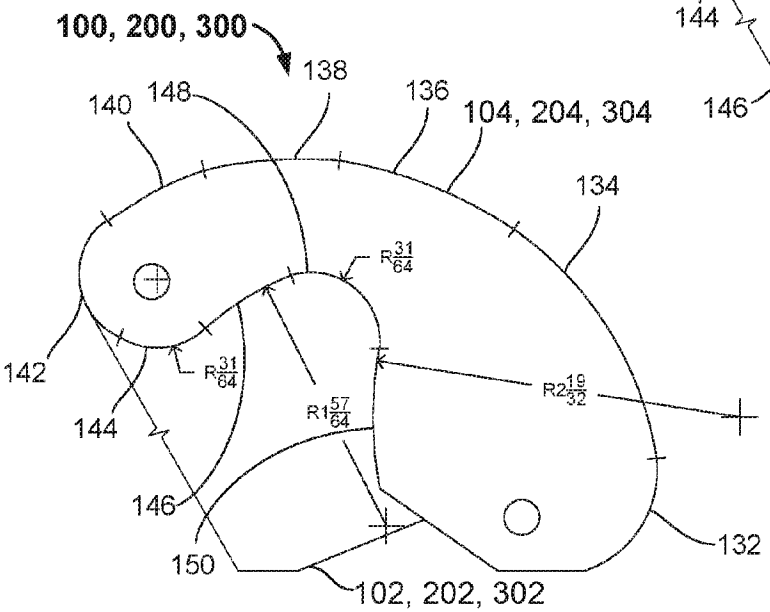
FIG. 15C is a fragmentary side elevation view of a floor groover according to multiple embodiments of the invention, illustrating curvature regions extending around a portion of a handle thereof.
Figure 16:
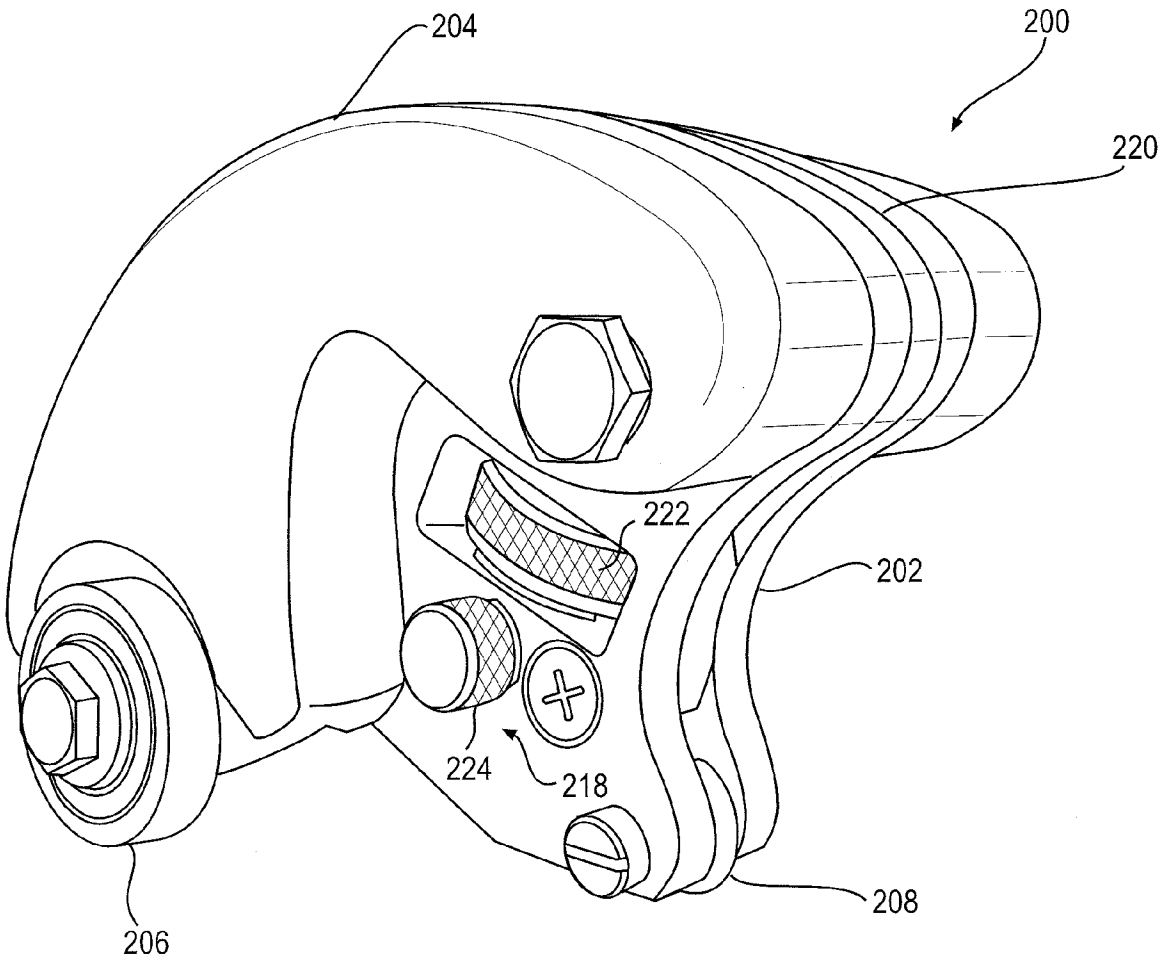
FIG. 16 is a perspective view of another embodiment of a floor groover.
Figure 17:
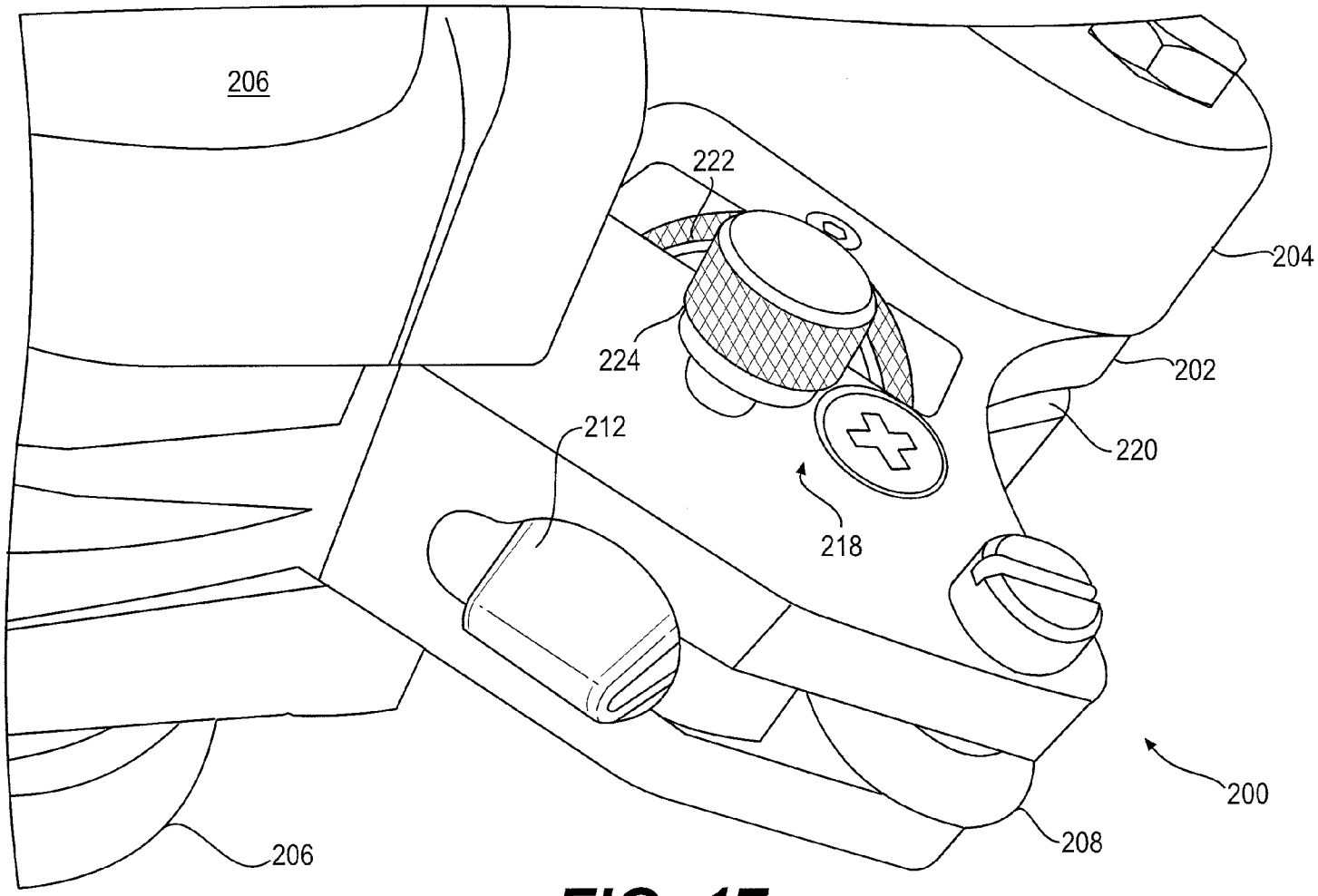
FIG. 17 is a fragmentary bottom perspective view of the floor groover of FIG. 16.
Figure 18:
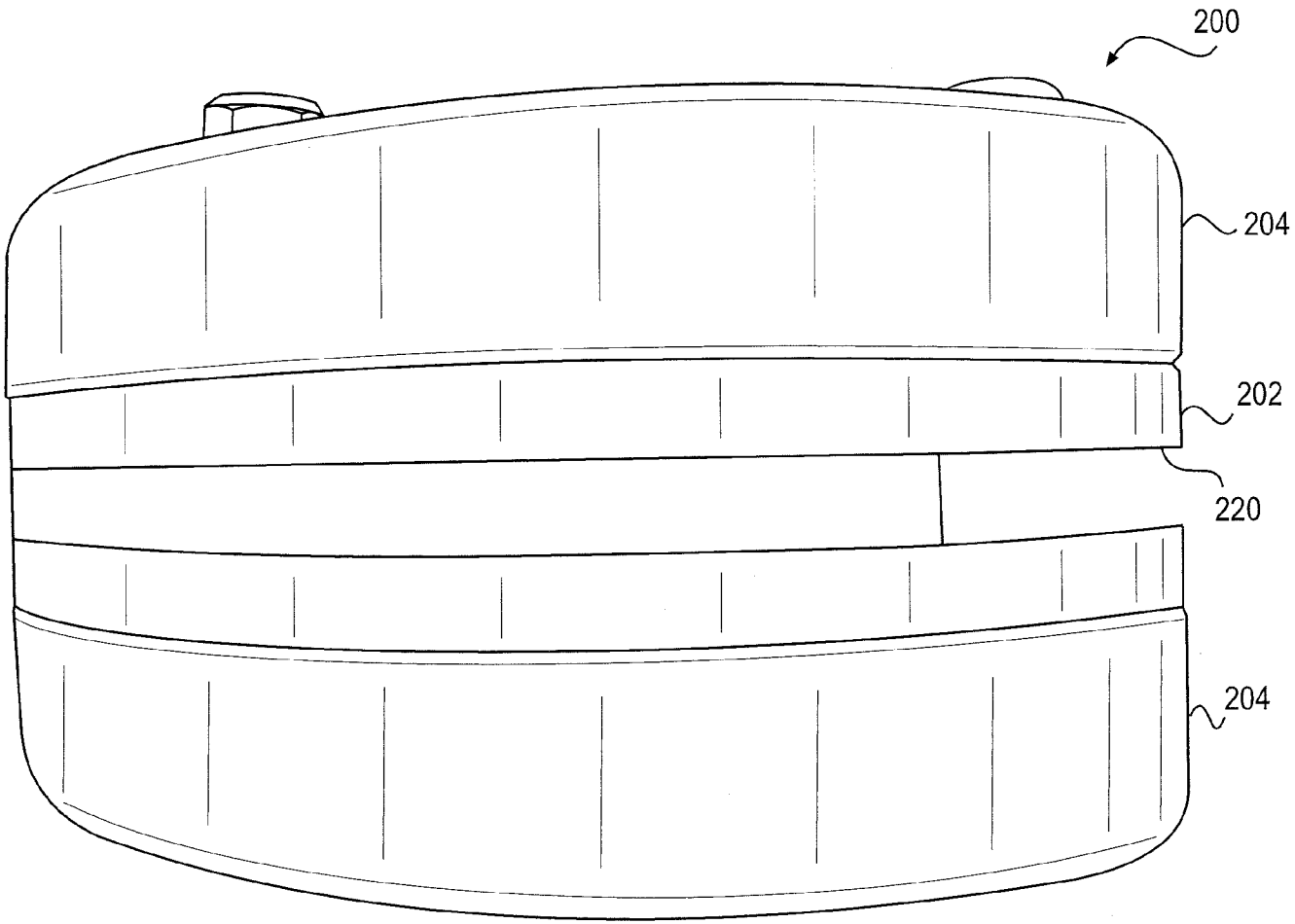
FIG. 18 is a top plan view of the floor groover of FIG. 16.
Figure 19:
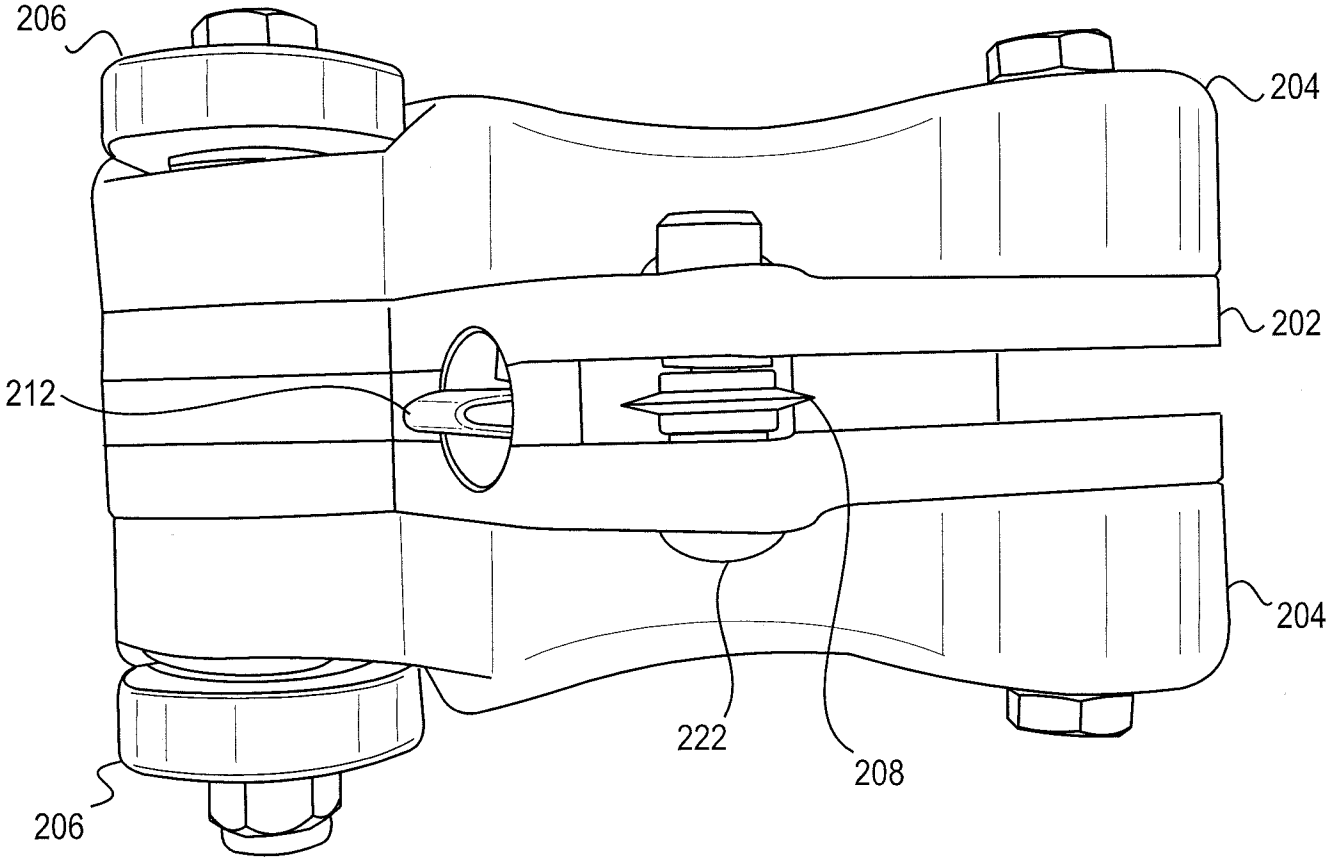
FIG. 19 is a bottom view of the floor groover of FIG. 16.
Figure 20:
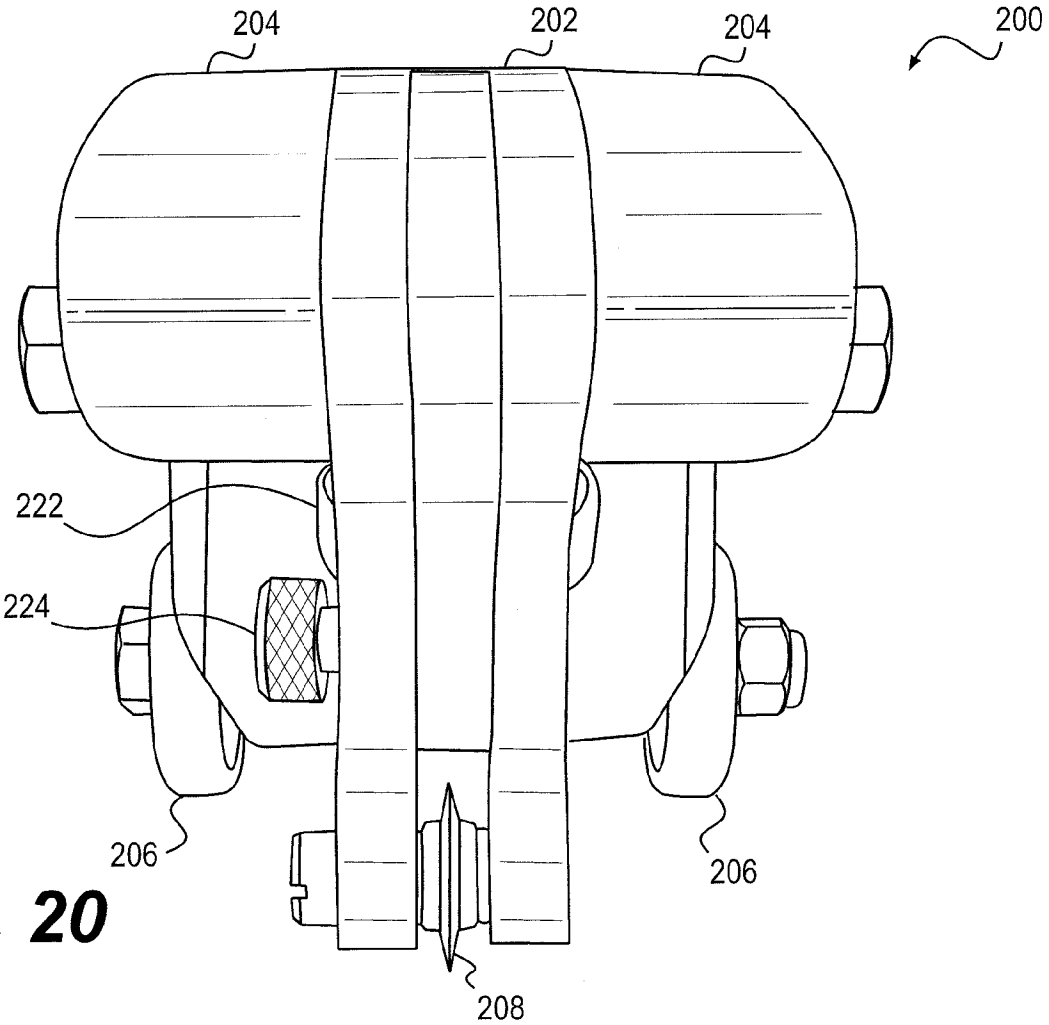
FIG. 20 is a front side view of the floor groover of FIG. 16.
Figure 21:
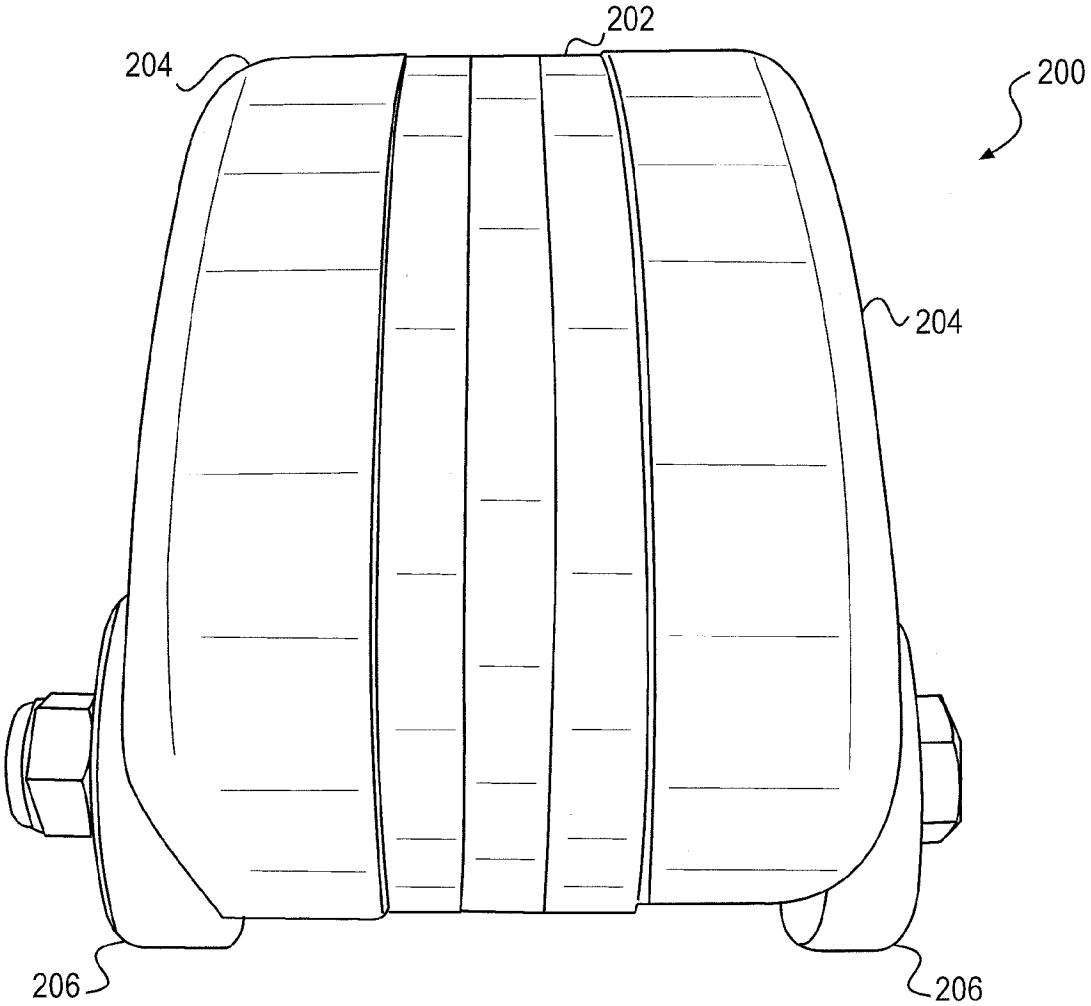
FIG. 21 is a rear side view of the floor groover of FIG. 16.
Figure 22:
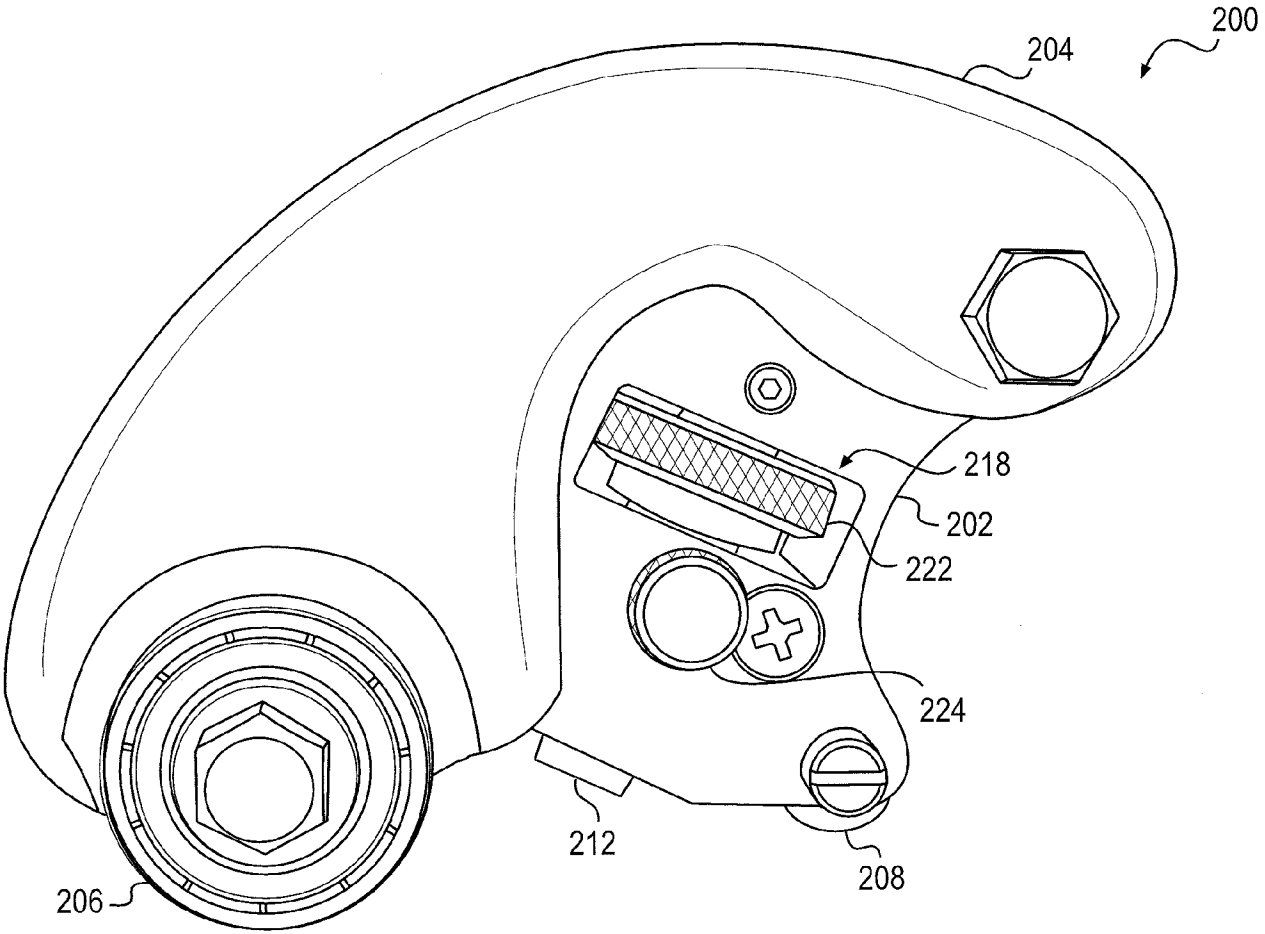
FIG. 22 is a side view of the floor groover of FIG. 16.
Figure 23:
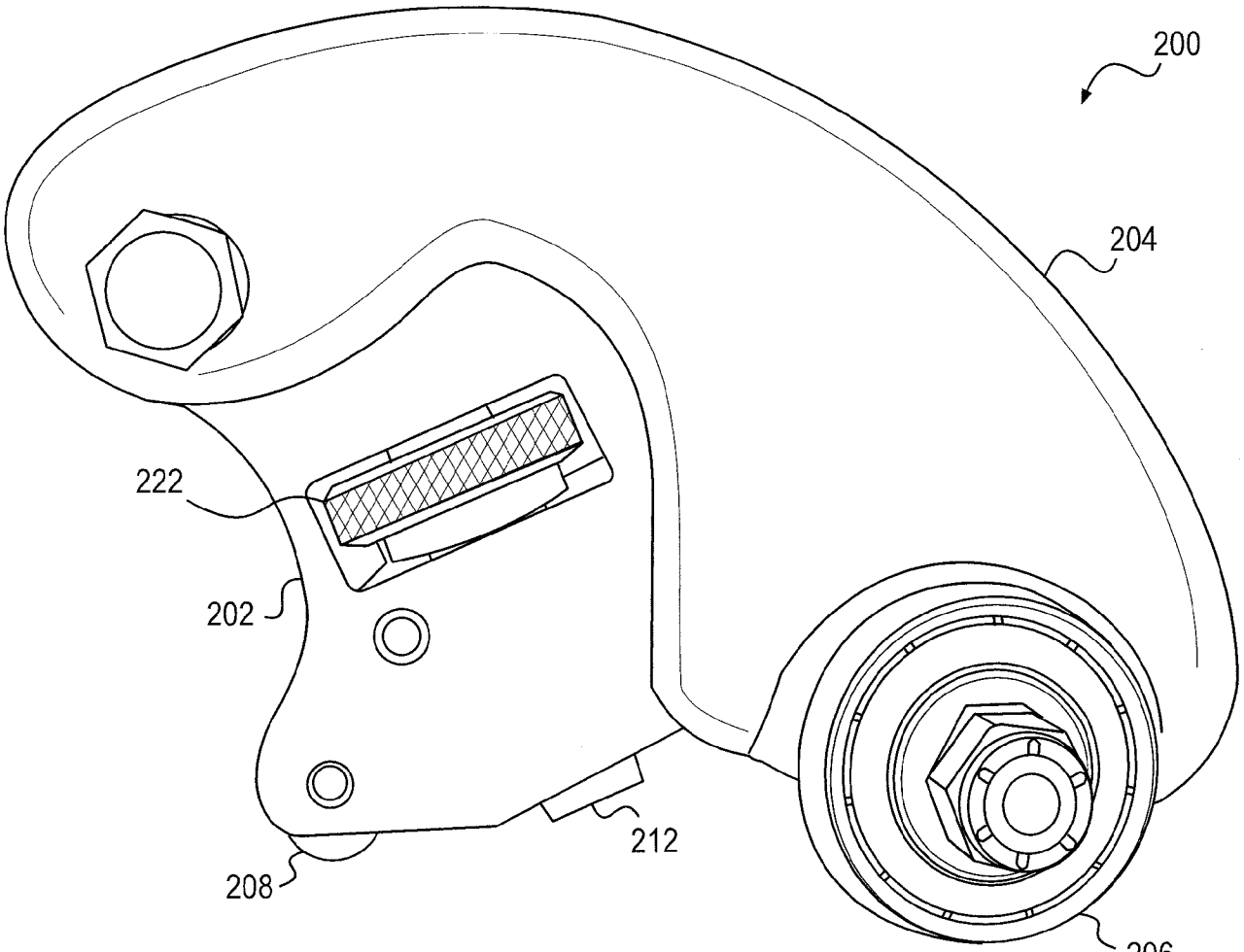
FIG. 23 is another side view of the floor groover of FIG. 16.

With reference to FIGS. 15A and 15B, the operation of tool 100 to cut downwardly along a vertical portion and a radiused portion of a seam at a coved area of flooring is illustrated. In particular, FIG. 15A shows tool 100 in a reversed and inverted position at the initiation of a downward cut along a seam s extending along a vertical wall base portion W of a section of flooring material and a radiused curve r joining wall base portion w with a floor portion F of the flooring material, to form vertical and curved segments of a groove q cut from seam s. Depicted in FIG. 15B is the position of tool 100 at the end of the downward and curved continuous cut made by pivoting tool 100 counterclockwise from the initial position shown in FIG. 15A, a cutting motion inherently and advantageously facilitated by the curved profile of handle 104, which permits tool 100 supported by handle 104 on floor portion F to rock smoothly through the downward and curved cutting motions. Distinct curved segments 132, 134, 136, 138, 140, 142, 144, 146, 148, 150 of handle 104 according to an illustrated embodiment are shown in FIGS. 15C and 15D for a handle 104, 204, 304 and body 102, 202, 302 of a floor groover 100, 200, 300 according to any of the illustrated embodiments, each having a suitable radius of curvature value (in inches) designated. It will be appreciated that larger radii of curvature 140 (2 45/64 in.), 138 (3 1/8 in.), and 136 (3 1/8 in.) at a top region of handle 104, 204, 304 facilitate forming a nearly straight downward groove cut from the initial position of groover 100 shown in FIG. 15A, and the smallest radius of curvature 132 (49/64in.) facilitates forming a tightly curved groove cut when blade 114 is disposed in the portion of seam s corresponding to radiused curve r.

The groover 200 can have a main grooving blade 212 disposed in a suitable position on the body 202, such as disposed generally centrally on the body 202. The main grooving blade 212 can be disposed at any suitable angle to provide a controlled and reliable grooving of the flooring material. The main blade 212 can be removeably attached to the body 202 such that it can be replaced when it becomes worn. An adjustment mechanism 218 can include a thumbscrew 222 for raising and lowering the main grooving blade 212 to a desired position. This permits the user to adjust the depth of the groove. A locking screw 224 can be used to lock the position of the main grooving blade 212 and to release the blade 212 for raising and lowering with the thumbscrew 222, and removal.

Figure 24:
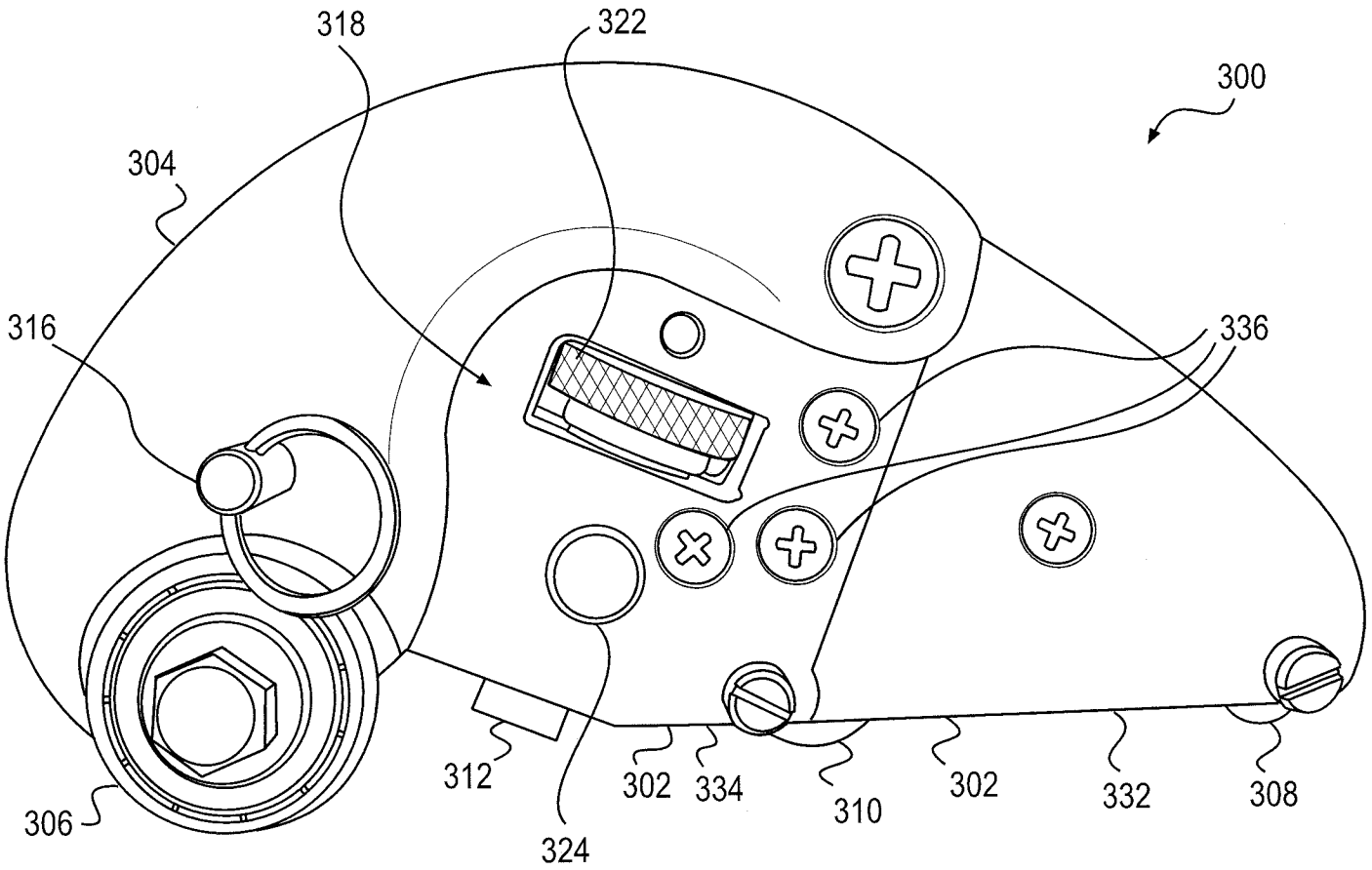
FIG. 24 is a side view of a further embodiment of a floor groover.
Figure 25:
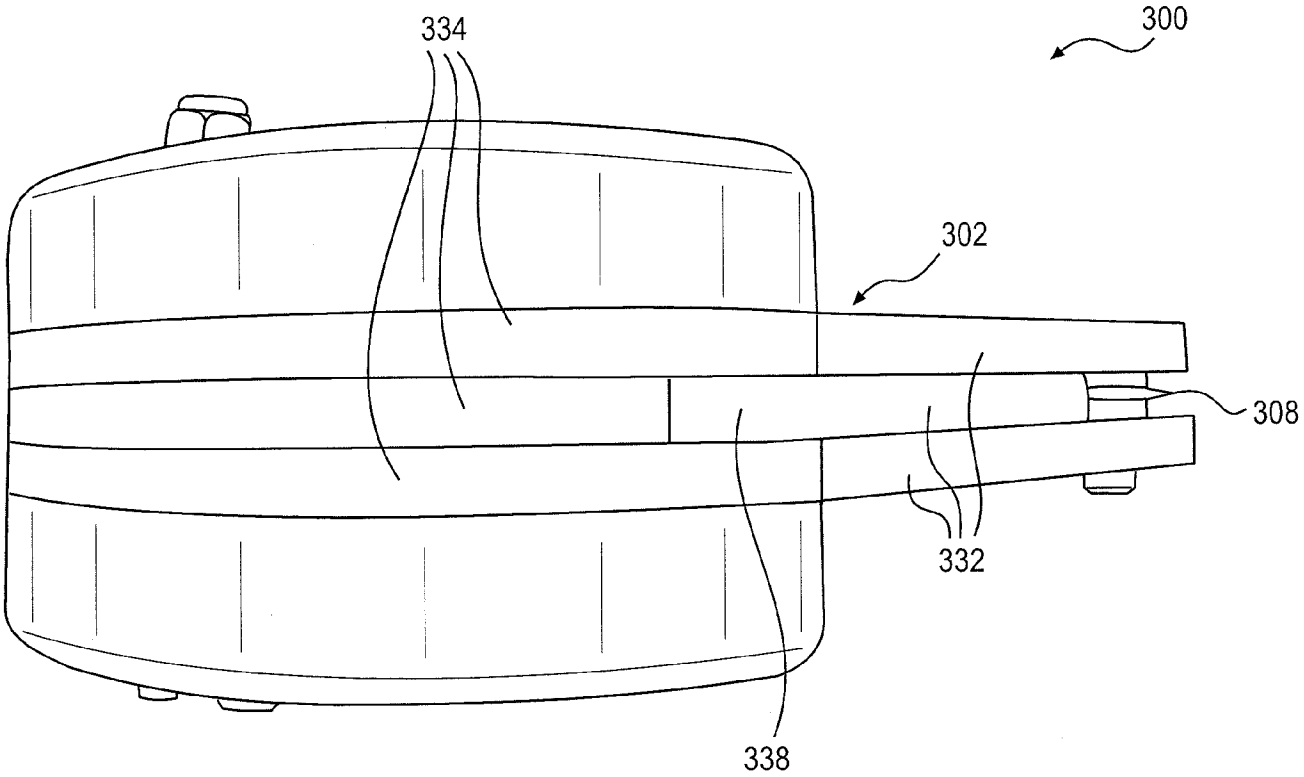
FIG. 25 is a top view of the floor groover of FIG. 24.
Figure 26:
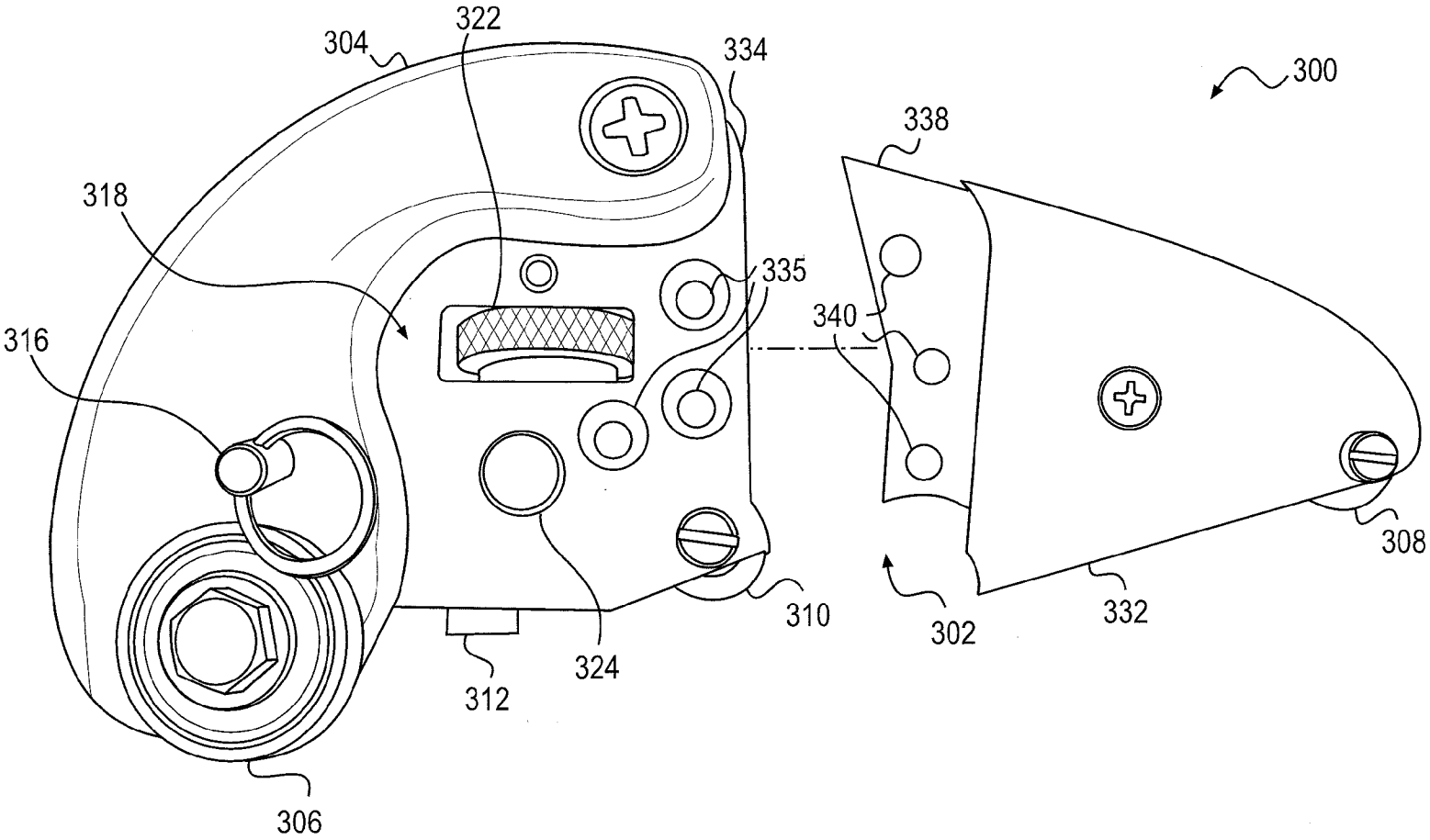
FIG. 26 is an exploded side view of the floor groover of FIG. 24.

FIGS. 24-26 show a further embodiment of a floor groover 300 combining features of the embodiments described above. For example, as in the embodiments above, the floor groover can have features such as a body 302, a handle 304, wheels 306, guide wheels 308, 310, a main grooving blade 312, a secondary grooving blade (not shown), a locking pin 316, a blade adjustment mechanism 318, a sight guide (not shown), a thumbscrew 322, a locking screw 324, and any other suitable features. Thus, the groover 300 can operate similar to the groover 100 to cut a groove in a floor, wall, and/or flash coving.

Unlike the groover 100, the groover 300 is convertible from a groover similar to groover 100 into a groover similar to the groover 200. The groover 300 can have a body 302 with a first body portion 332 and a second body portion 334. The first body portion 332 can be separated from the second body portion 334 to permit the second body portion 334 and the rest of the groover attached to the second body portion 334 to have a smaller turning radius in order to make the groover 300 more maneuverable. Removeable fasteners 336 can be used to attach the first body portion 332 to the second body portion 334. The fasteners 336 can be inserted into apertures 335 in the second body portion 334 and corresponding apertures 340 in a connection portion 338 of the first body portion 332 to secure the first body portion 332 to the second body portion 334. The space vacated by the connection portion 338 upon removal of the first body portion 332 forms a sight guide in the second body portion 334.

In general, at least two types of grooving blades can be used with the groover, a planar grooving blade and a rod-like grooving blade. The planar grooving blade can have an elongated rectangular shape and can be formed by folding the blade in half into a general U-shape. The planar grooving blade can be attached to the grooving blade holder 130 of FIGS. 14 and 15, which fits within the body 102 and is attached to the thumbscrew 122.

Alternatively, a rod-like grooving blade can be attached directly to the thumbscrew 122 or an intermediary fitting can be used to attach the rod-like grooving blade to the thumbscrew 122. For example, the rod-like grooving blade can generally be an elongated rod with an opening near an end of the rod. When using a rod-like grooving blade, the blade can extend from the blade opening in the body to contact a surface for grooving. The rod-like grooving blade can be held in place with a set screw. Accordingly, the groovers described herein are capable of being used with either of these types of grooving blades, or any other suitable grooving blade.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A floor groover comprising:

a body having a length defining a longitudinal groove cutting direction, a width perpendicular to the length, a top side, a bottom side, a left side, a right side, a front side, and a rear side;

a first grooving blade coupled to the body, including a first grooving blade cutting edge disposed below a bottom side of the body, the first grooving blade comprising a cutting edge extending transversely to the longitudinal groove cutting direction, comprising a lower middle portion and upturned left-side and right-side portions, and being configured to engage a seam formed by abutting contact of adjacent floor coverings, when the body is placed on top of the seam, and to cut a groove along the seam when the body is moved along the seam in said longitudinal direction;

a second grooving blade coupled to a an adjustment block that is pivotably coupled to the body such that the second grooving blade can be secured in a plurality of positions at a plurality of different angular orientations with respect to the body by securing the adjustment block at a plurality of corresponding positions, including a wall grooving orientation in which a second grooving blade cutting edge is disposed at a location rearward of the rear of the body;

at least one of the first grooving blade and the second grooving blade being a planar grooving blade formed into a U shape and including upturned straight portions disposed to the left and right of a bottom curved portion; and the body including a convex curved face extending at least from the position of the second grooving blade cutting edge in the wall grooving orientation to a highest point of the body.

2. The floor groover of claim 1 further comprising a first guide coupled to the body.

3. The floor groover of claim 2 further comprising a second guide coupled to the body, wherein the second guide is disposed between the first guide and the first grooving blade.

4. The floor groover of claim 2 wherein the body includes a first portion and a second portion, the first guide being coupled to the first portion and the first grooving blade being coupled to the second portion, the first portion being separable from the second portion such that when the first portion is separated from the second portion, the second portion can be used as a floor groover.

5. The floor groover of claim 1 wherein the adjustment block has a plurality of openings for receiving a locking pin to secure the second grooving blade in one of the respective plurality of positions.

6. The floor groover of claim 1 further comprising two wheels laterally offset from the second grooving blade such that the second grooving blade is disposed at least partially between the two wheels.

7. The floor groover of claim 1 further comprising a blade adjustment mechanism coupled to the first grooving blade and the body for adjusting the position of the first grooving blade with respect to the body.

8. The floor groover of claim 1 wherein the body includes an opening forming a sight guide.

9. A floor groover comprising:

a body having a length, a width perpendicular to the length, a top side, a bottom side, a front side, and a rear side;

a first seam guide coupled to the body;

a second seam guide coupled to the body, each of the first and second seam guides having a V-shaped cross section extending downwardly to a pointed edge below the bottom side of the body and adapted to be inserted into a tight seam of abutting adjacent floor coverings; and a first grooving blade coupled to the body and comprising a groove cutting channel terminating at a cutting edge facing in a longitudinal groove cutting direction parallel to said length of the body, such that the second seam guide is disposed between the first seam guide and the first grooving blade, and both the seam guides are disposed in front of the first grooving blade in the longitudinal groove cutting direction;

the first grooving blade being a planar grooving blade formed into a U shape and including upturned straight portions disposed to the left and right of a bottom curved portion.

10. The floor groover of claim 9 wherein the body includes a first portion and a second portion, the first seam guide being coupled to the first portion and the first grooving blade being coupled to the second portion, the first portion being separable from the second portion such that when the first portion is separated from the second portion, the second portion can be used as a floor groover.

11. The floor groover of claim 9 further comprising a second grooving blade coupled to the body.

12. The floor groover of claim 9 further comprising two wheels laterally offset from the first grooving blade and configured to roll in a direction parallel to the longitudinal groove cutting direction.

13. The floor groover of claim 9 further comprising a blade adjustment mechanism coupled to the first grooving blade and the body for adjusting the position of the first grooving blade with respect to the body.

14. The floor groover of claim 9 wherein the body includes an opening forming a sight guide.

15. A floor groover comprising:

a body including a first portion and a second portion, the first portion being separable from the second portion, a length defining a longitudinal groove cutting direction, a width perpendicular to the length, a top side, a bottom side, a left side, a right side, a front side, and a rear side;

a first seam guide coupled to the first portion;

a second seam guide coupled to the second portion; and a first grooving blade coupled to the second portion, the first grooving blade being a planar grooving blade formed into a U shape and including upturned straight portions disposed to the left and right of a bottom curved portion;

the first seam guide and the second seam guide each having a V-shaped cross section extending downwardly to a pointed edge below the bottom side of the body and adapted to be inserted into and to follow a tight seam formed by abutting contact of adjacent floor coverings;

when the first portion is connected to the second portion, the first seam guide and the second seam guide being disposed in front of the first grooving blade and spaced apart along the longitudinal groove cutting direction and positioned to be inserted into and to follow the tight seam of abutting pieces of flooring materials while at the same time the first grooving blade cuts along the seam in the cutting direction; and when the first portion is separated from the second portion, the second portion can be used as a floor groover by inserting the second seam guide into the tight seam of abutting pieces of flooring materials and cutting along the seam with the first grooving blade in the cutting direction while the second seam guide follows the seam.

16. The floor groover of claim 15 further comprising a second grooving blade coupled to the body.

17. The floor groover of claim 15 further comprising two wheels laterally offset from the first grooving blade such that in use they follow a path parallel to a path followed by the first grooving blade.

* * * * *